US007361042B2

(12) United States Patent
Hashimoto et al.

(10) Patent No.: US 7,361,042 B2
(45) Date of Patent: Apr. 22, 2008

(54) ELECTRICAL CONNECTOR

(75) Inventors: Yoshimitsu Hashimoto, Machida (JP); Jin Tateishi, Machida (JP); Yoshinobu Shimada, Machida (JP)

(73) Assignee: I-Pex Co., Ltd., Tokyo (JP)

( * ) Notice: Subject to any disclaimer, the term of this patent is extended or adjusted under 35 U.S.C. 154(b) by 0 days.

(21) Appl. No.: 11/507,592

(22) Filed: Aug. 22, 2006

(65) Prior Publication Data

US 2007/0072446 A1 Mar. 29, 2007

(30) Foreign Application Priority Data

Sep. 27, 2005 (JP) ..... 2005-279219

(51) Int. Cl.
*H01R 13/62* (2006.01)

(52) U.S. Cl. ..... 439/260; 439/267; 439/494

(58) Field of Classification Search ..... 439/260, 439/267, 494–497
See application file for complete search history.

(56) References Cited

U.S. PATENT DOCUMENTS

| | | | | |
|---|---|---|---|---|
| 4,718,859 | A * | 1/1988 | Gardner | 439/329 |
| 5,842,883 | A * | 12/1998 | Igarashi et al. | 439/495 |
| 6,056,572 | A * | 5/2000 | Matsumoto et al. | 439/260 |
| 6,431,897 | B1 * | 8/2002 | Hashiguchi et al. | 439/267 |
| 6,471,541 | B2 * | 10/2002 | Kunishi et al. | 439/495 |
| 6,517,367 | B2 * | 2/2003 | Yamane | 439/260 |
| 6,726,497 | B2 * | 4/2004 | Nogawa et al. | 439/260 |
| 6,755,682 | B2 * | 6/2004 | Kunishi et al. | 439/495 |
| 6,893,288 | B2 * | 5/2005 | Tsunematsu | 439/495 |
| 7,172,446 | B1 * | 2/2007 | Hashimoto et al. | 439/260 |
| 2005/0118849 | A1 * | 6/2005 | Okita et al. | 439/260 |
| 2006/0089036 | A1 * | 4/2006 | Takai et al. | 439/260 |
| 2006/0286843 | A1 * | 12/2006 | Fukazawa | 439/260 |

FOREIGN PATENT DOCUMENTS

| | | |
|---|---|---|
| JP | 11-307198 | 11/1999 |
| JP | 2002-270290 | 9/2002 |

* cited by examiner

*Primary Examiner*—Tho D. Ta
*Assistant Examiner*—Larisa Tsukerman
(74) *Attorney, Agent, or Firm*—Donald R. Studebaker; Nixon Peabody LLP

(57) ABSTRACT

An electrical connector including a housing, first and second contacts arranged in the housing, each of which has a fixed part engaging with a board-shaped portion of the housing and an operating part movable to the fixed part, and an actuator movable to the housing for taking up first and second stations selectively, wherein each of the first and second contacts is shaped to have substantially the same space between the fixed and operating parts thereof or between the operating part thereof and the board-shaped portion of the housing when the actuator is postured to take the first station and a circuit board is not inserted into the housing. The actuator includes a plurality of cams each engaging with one of the first and second contacts, wherein each of the cams corresponding to the first contacts and each of the cams corresponding to the second contacts are different in shape from each other.

9 Claims, 13 Drawing Sheets

ELECTRICAL CONNECTOR

BACKGROUND OF THE INVENTION

1. Field of the Invention

The present invention relates generally to an electrical connector, and more particularly to an improvement in an electrical connector used for putting connecting terminals provided on a circuit board, such as a flexible printed circuit board (FPC), conductors provided in a flexible flat cable assembly (FFC) or the like in electrical connection with another electrical device, such as a main solid circuit board.

2. Description of the Prior Art

In the field of electronic apparatus including various portable telephones, a relatively small-sized flexible printed circuit board or flexible flat cable assembly is often mounted on a main printed circuit board, on which various electrical parts are directly mounted, by means of an electrical connector which is fixed to and connected electrically with the main printed circuit board. The electrical connector has a plurality of conductive contacts for coming into contact with connecting terminals provided on the flexible printed circuit board or conductors in the flexible flat cable assembly and is operative to connect, through the conductive contacts, the connecting terminals provided with the flexible printed circuit board or the conductors in the flexible flat cable assembly with conducting circuit pattern portions formed on the main printed circuit board.

For example, a previously proposed electrical connector, which is used for mounting a flexible printed circuit board on a main printed circuit board, is provided with a housing made of insulator which has an opening through which the flexible printed circuit board is partially inserted into the housing. In the housing, a plurality of conductive contacts are arranged along the opening. These conductive contacts are operative to come into contact with a plurality of connecting terminals provided on the flexible printed circuit board when the flexible printed circuit board is partially inserted into the housing through the opening. The electrical connector is further provided with an actuator which is supported rotatably to the housing to be common to the conductive contacts arranged in the housing. When the actuator is rotated in regard to the housing, each of the conductive contacts is partially moved in the housing.

Each of the conductive contacts arranged in the housing is made of conductive resilient material to have a fixed part which is fixed to the housing and a movable part coupled with the fixed part. The fixed part of the contact is connected electrically with a conducting circuit pattern portion provided on the main printed circuit board. The movable part of the conductive contact constitutes an operating part which is moved by the actuator.

In the previously proposed electrical connector as mentioned above, when the flexible printed circuit board is partially inserted into the housing through the opening provided thereon and the actuator is rotated in a predetermined direction, the actuator operates to move the operating part of each of the conductive contacts to come into press-contact with a corresponding one of the connecting terminals provided on the flexible printed circuit board so that the flexible printed circuit board is held by the conductive contacts, as shown in, for example, the Japanese patent application published before examination under publication number 2002-270290 (Publication document 1). Then, when the actuator, by which the operating part of each of the conductive contacts is brought into press-contact with the corresponding connecting terminal provided on the flexible printed circuit board so that the flexible printed circuit board is held by the conductive contacts, is rotated in a direction opposite to the predetermined direction, the operating part of each of the conductive contacts is allowed by the actuator to move for getting out of press-contact with the corresponding connecting terminal provided on the flexible printed circuit board so that the flexible printed circuit board is loosened from holding by the conductive contacts.

In such an electrical connector as shown in the published document 1, each of the conductive contacts is formed into an H-shaped member. The H-shaped member has a pair of beams coupled with each other through a connecting portion. One of the beams constitutes the fixed part of the conductive contact and the other of the beams constitutes the operating part of the conductive contact. When the flexible printed circuit board is partially inserted into the housing through the opening provided thereon, a part of the flexible printed circuit board, on which the connecting terminals are provided, is put between the fixed and operating parts of each of the conductive contacts so that the flexible printed circuit board is temporary held by the conductive contacts.

Then, when the actuator is rotated for moving the operating part of each of the conductive contacts to come into press-contact with the corresponding connecting terminal on the flexible printed circuit board, the part of the flexible printed circuit board, on which the connecting terminals are provided, is held between the fixed part of each of the conductive contacts and the operating part of each of the conductive contacts which is brought into press-contact with the corresponding connecting terminal.

Further, there has been another type of the previously proposed electrical connector which is provided with a housing having an opening through which a flexible printed circuit board is partially inserted into the housing, a plurality of conductive contacts arranged along the opening on the housing and an actuator rotatable to the housing in almost the same manner as those of the electrical connector shown in the publication document 1, and in which the conductive contacts, each of which is formed into an H-shaped member having fixed and operating parts coupled with each other through a connecting portion, include first and second contacts different in shape from each other, as shown in, for example, the Japanese patent application published before examination under publication number HEI11-307198 (Publication document 2). In this type of electrical connector, each of the first contacts is shaped to have a relatively narrow space between the fixed and operating parts thereof and each of the second contacts is shaped to have a relatively broad space between the fixed and operating parts thereof. The operating part of each of the first contacts extends into the opening provided on the housing to reach more deeply than the operating part of each of the second contacts extending into the opening.

In the electrical connector as shown in the published document 2, when the flexible printed circuit board is partially inserted into the housing through the opening provided thereon and a part of the flexible printed circuit board, on which the connecting terminals are provided, is put between the fixed and operating parts of each of the first and second contacts, the flexible printed circuit board is temporarily held substantially by the first contacts, each of which is shaped to have the relatively narrow space between the fixed and operating parts thereof. That is, only each of the first contacts is operative to exert temporarily substantial holding force on the flexible printed circuit board inserted partially into the housing.

In the electrical connector thus proposed previously to be used for mounting the flexible printed circuit board on the main printed circuit board, when the flexible printed circuit board is partially inserted into the housing through the opening provided thereon, the part of the flexible printed circuit board inserted into the housing is put between the fixed and operating parts of each of the conductive contacts arranged in the housing and thereby the flexible printed circuit board is temporarily held by the conductive contacts. The conductive contacts thus holding temporarily the flexible printed circuit board is operative to exert temporary holding force on the flexible printed circuit board inserted partially into the housing.

An intensity of temporary holding force by each of the conductive contacts acting on the flexible printed circuit board in the previously proposed electrical connector is in inverse proportion to the space between the fixed and operating parts of each of the conductive contacts in the opening provided on the housing in a condition in which the actuator is inoperative. That is, the intensity of temporary holding force by each of the conductive contacts acting on the flexible printed circuit board is relatively small when each of the conductive contacts is formed to have a relatively broad space between the fixed and operating parts thereof and the intensity of temporary holding force by each of the conductive contacts acting on the flexible printed circuit board is relatively large when each of the conductive contacts is formed to have a relatively narrow space between the fixed and operating parts thereof. Then, after the conductive contacts have been once assembled into the housing, it is difficult to control the intensity of temporary holding force by each of the conductive contacts acting on the flexible printed circuit board.

It has been usual that the conductive contacts are desired to be sure in a certain extent in holding temporarily the flexible printed circuit board when the flexible printed circuit board is inserted partially into the housing and therefore it is likely to set each of the conductive contacts to exert a relatively large temporary holding force on the flexible printed circuit board inserted partially into the housing. However, in the electrical connector as shown in the published document 1, since the flexible printed circuit board is inserted partially into the housing against the temporary holding force by each of the conducting contacts acting on the flexible printed circuit board, a disadvantage that a relatively large thrusting force is required for inserting the flexible printed circuit board partially into the housing and therefore a thrusting operation for partial insertion of the flexible printed circuit board into the housing is deteriorated in operability is brought about when each of the conductive contacts is set to exert the relatively large temporary holding force on the flexible printed circuit board inserted partially into the housing. This disadvantage is especially severe when a large number of conductive contacts are provided in the housing.

Further, in the case of the electrical connector as shown in the published document 2, since only each of the first contacts, which is shaped to have the relatively narrow space between the fixed and operating parts thereof, is operative to exert substantially the temporary holding force on the flexible printed circuit board inserted partially into the housing, it is avoidable to set the temporary holding force acting on the flexible printed circuit board inserted partially into the housing to be relatively large. However, in the electrical connector as shown in the published document 2, the first contacts, each of which is shaped to have the relatively narrow space between the fixed and operating parts thereof, and the second contacts, each of which is shaped to have the relatively broad space between the fixed and operating parts thereof, are intermixed in the housing and therefore a disadvantage that an inspection and control with the aid of an image processing apparatus to the conductive contacts including the first and second contacts cannot be surely and effectively conducted, so that a quality control for keeping the electrical connector in quality at a predetermined level is inevitably complicated and lacking in reliability are brought about.

OBJECTS AND SUMMARY OF THE INVENTION

Accordingly, it is an object of the present invention to provide an electrical connector used, for example, for mounting a flexible printed circuit board on a main printed circuit board, which comprises a housing made of insulator and provided with an opening through which a circuit board is partially inserted into the housing, a plurality of conductive contacts arranged in the housing, and an actuator provided to be rotatable to the housing for engaging with the conductive contacts and operative to move a movable portion of each of the conductive contacts when rotated in regard to the housing, and which avoids the aforementioned disadvantages encountered with the prior art.

Another object of the present invention is to provide an electrical connector used, for example, for mounting a flexible printed circuit board on a main printed circuit board, which comprises a housing made of insulator and provided with an opening through which a circuit board is partially inserted into the housing, a plurality of conductive contacts arranged in the housing, and an actuator provided to be rotatable to the housing for engaging with the conductive contacts and operative to move a movable portion of each of the conductive contacts when rotated in regard to the housing, and in which a thrusting operation for inserting the circuit board partially into the housing is prevented from being deteriorated in operability.

A further object of the present invention is to provide an electrical connector used, for example, for mounting a flexible printed circuit board on a main printed circuit board, which comprises a housing made of insulator and provided with an opening through which a circuit board is partially inserted into the housing, a plurality of conductive contacts arranged in the housing, and an actuator provided to be rotatable to the housing for engaging with the conductive contacts and operative to move a movable portion of each of the conductive contacts when rotated in regard to the housing, and in which an inspection and control with the aid of an image processing apparatus to the conductive contacts can be surely and effectively conducted.

A still further object of the present invention is to provide an electrical connector used, for example, for mounting a flexible printed circuit board on a main printed circuit board, which comprises a housing made of insulator and provided with an opening through which a circuit board is partially inserted into the housing, a plurality of conductive contacts arranged in the housing, and an actuator provided to be rotatable to the housing for engaging with the conductive contacts and operative to move a movable portion of each of the conductive contacts when rotated in regard to the housing, and in which a quality control for keeping the electrical connector in quality at a predetermined level can be simplified and improved in reliability.

According to the present invention, as claimed in any one of claims, there is provided an electrical connector, which comprises a housing made of insulator and provided with an opening through which a circuit board is partially inserted into the housing, a plurality of conductive contacts arranged in the housing, each of which has a fixed part engaging with a board-shaped portion of the housing and an operating part movable to the fixed part, and an actuator provided to be rotatable to the housing for engaging with the conductive contacts and to take up first and second stations selectively for moving the operating part of each of the conductive contacts to come into press-contact with one of the connecting terminals corresponding thereto so that the circuit board is held by the conductive contacts when the circuit board is partially inserted into the housing through the opening provided thereon and the actuator is shifted from the first station to the second station and for moving the operating part of each of the conductive contacts to get out of press-contact with the corresponding one of the connecting terminals so that the circuit board is loosened from holding by the conductive contacts when the circuit board is partially inserted into the housing through the opening provided thereon and the actuator is shifted from the second station to the first station, wherein the conductive contacts provided in the housing include first and second contacts, each of which is shaped to have substantially the same space between the fixed and operating parts thereof or between the operating part thereof and the board-shaped portion of the housing with which the fixed part thereof engages when the actuator is postured to take the first station and the circuit board is not inserted into the housing, and the operating part of each of the first contacts exerts on the circuit board a first temporary holding force which is different from a second temporary holding force exerted on the circuit board by the operating part of each of the second contacts when the actuator is postured to take the first station and the circuit board is partially inserted into the housing through the opening provided thereon.

Especially, in one embodiment of electrical connector according to the present invention, the actuator has a plurality of cams each engaging with one of the first and second contacts arranged in the housing and operative to move the operating part of the first or second contact to come into press-contact with the connecting terminal provided on the circuit board which is partially inserted into the housing through the opening provided thereon when the actuator is shifted from the first station to the second station. When the actuator is postured to take the first station and the circuit board is to be partially inserted into the housing through the opening provided thereon, each of the cams corresponding to the first contacts engages with the operating part of one of the first contacts in a first predetermined manner and each of the cams corresponding to the second contacts engages with the operating part of one of the second contacts in a second predetermined manner different from the first predetermined manner.

In the electrical connector thus constituted in accordance with the present invention, when the actuator is postured to take the first station and the circuit board is not inserted into the housing, each of the first and second contacts arranged in the housing has substantially the same space between the fixed and operating parts thereof or between the operating part thereof and the board-shaped portion of the housing with which the fixed part thereof engages. Then, when the circuit board is partially inserted into the housing through the opening provided thereon and the actuator is rotated to move from the first station toward the second station, the actuator in the movement from the first station toward the second station operates to bring each of the first and second contacts arranged in the housing into press-contact with one of the connecting terminals provided on the circuit board corresponding thereto, for example, by causing the cams to move the operating part of each of the first and second contacts, so that the circuit board is held by the first and second contacts. After that, when the actuator is rotated to move from the second station toward the first station, the actuator in the movement from the second station toward the first station operates to cause each of the first and second contacts to get out of press-contact with the corresponding one of the connecting terminals, for example, by causing the cams to move the operating part of each of the first and second contacts, so that the circuit board is loosened from holding by the first and second contacts.

In such operations, when the circuit board is partially inserted into the housing through the opening provided thereon, the actuator postured to take the first station is operative to cause the operating part of each of the first contacts to exert on the circuit board the first temporary holding force which is different from than the second temporary holding force exerted on the circuit board by the operating part of each of the second contacts. The second temporary holding force is set to be, for example, extremely smaller than the first temporary holding force. The difference between the first temporary holding force and the second temporary holding force both acting on the circuit board is brought about, for example, by the actuator postured to take the first station, which causes each of the cams corresponding to the first contacts to engage with the operating part of one of the first contacts in the first predetermined manner and each of the cams corresponding to the second contacts to engage with the operating part of one of the second contacts in the second predetermined manner different from the first predetermined manner.

Consequently, the operating part of each of the first contacts is operative to exert mainly an effective temporary holding force on the circuit board partially inserted into the housing and the operating part of each of the second contacts is not operative substantially to exert any effective temporary holding force on the circuit board. This means substantially that only the first temporary holding force by the operating part of each of the first contacts acts on the circuit board partially inserted into the housing.

With the electrical connector thus constituted in accordance with the present invention, in which the conductive contacts provided in the housing include first and second contacts, each of which is shaped to have substantially the same space between the fixed and operating parts thereof or between the operating part thereof and the board-shaped portion of the housing with which the fixed part thereof engages under the condition in which the actuator is postured to take the first station and the circuit board is not inserted into the housing, when the actuator is postured to take the first station and the circuit board is partially inserted into the housing through the opening provided thereon, the operating part of each of the first contacts exerts on the circuit board the first temporary holding force which is different from the second temporary holding force exerted on the circuit board by the operating part of each of the second contacts. The second temporary holding force is set to be, for example, extremely smaller than the first temporary holding force so that the operating part of each of the first contacts is operative substantially to exert mainly the effective temporary holding force on the circuit board partially inserted into the housing.

Accordingly, the effective temporary holding force acting on the circuit board partially inserted into the housing can be controlled to be appropriate by selecting suitably the number of the first contacts which are included in the conductive contacts arranged in the housing even if a large number of conductive contacts are provided in the housing. As a result, such a situation in which a relatively large thrusting force is required for inserting the flexible printed circuit board partially into the housing and therefore the thrusting operation for partial insertion of the flexible printed circuit board into the housing is deteriorated in operability is surely avoided.

Further, since each of the first and second contacts is shaped to have substantially the same space between the fixed and operating parts thereof or between the operating part thereof and the board-shaped portion of the housing with which the fixed part thereof engages under the condition in which the actuator is postured to take the first station and the circuit board is not inserted into the housing, the inspection and control with the aid of the image processing apparatus to the conductive contacts including the first and second contacts can be surely and effectively conducted, so that the quality control for keeping the electrical connector in quality at the predetermined level can be simplified and improved in reliability.

The above, and other objects, features and advantages of the present invention will become apparent from the following detailed description taken in conjunction with the accompanying drawings.

DESCRIPTION OF THE PREFERRED EMBODIMENTS

Figure 1:
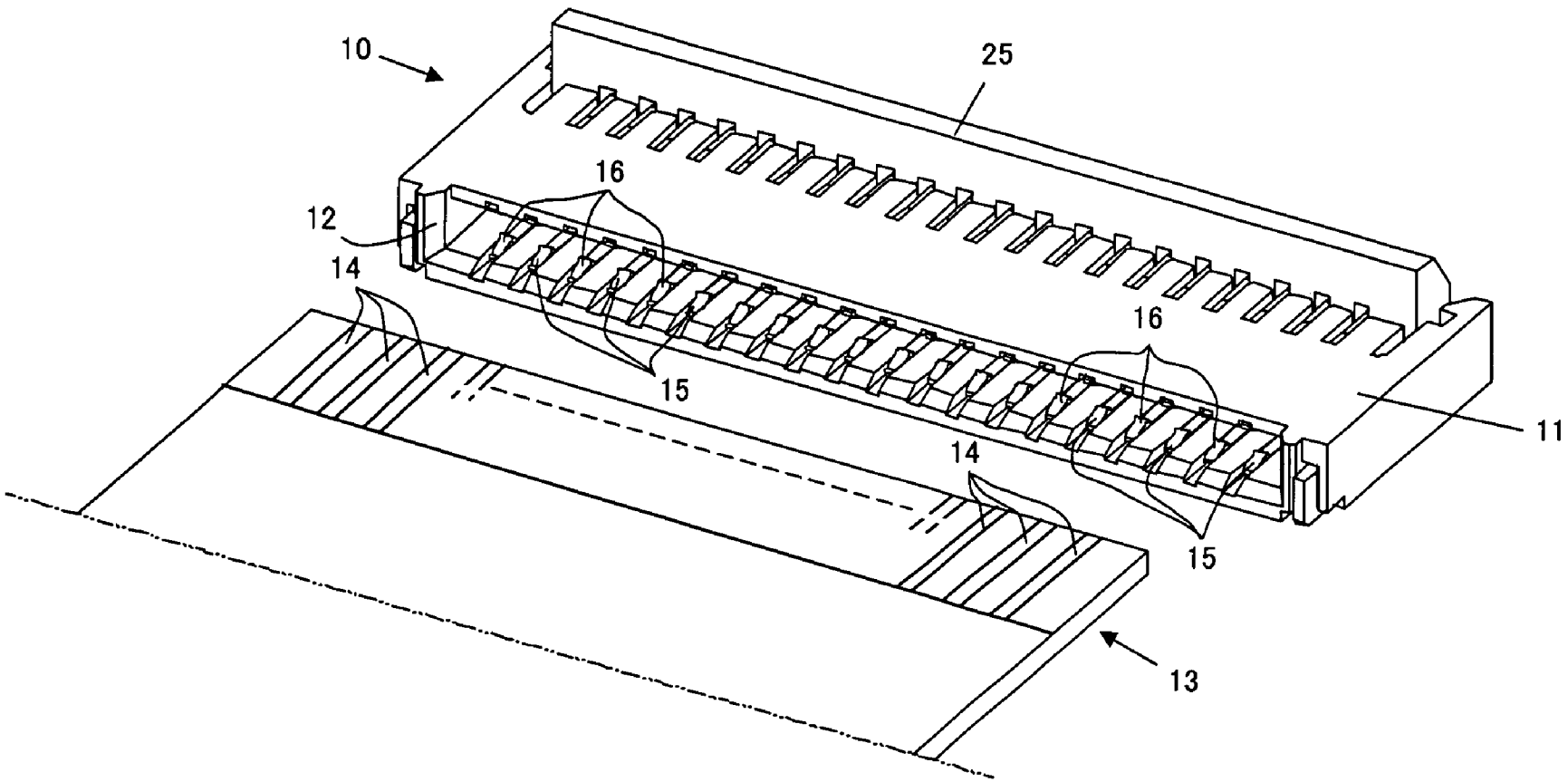
FIG. 1 is a schematic perspective view showing a first embodiment of electrical connector according to the present invention, together with a part of a flexible printed circuit board which is to be partially inserted into the first embodiment.
Figure 2:
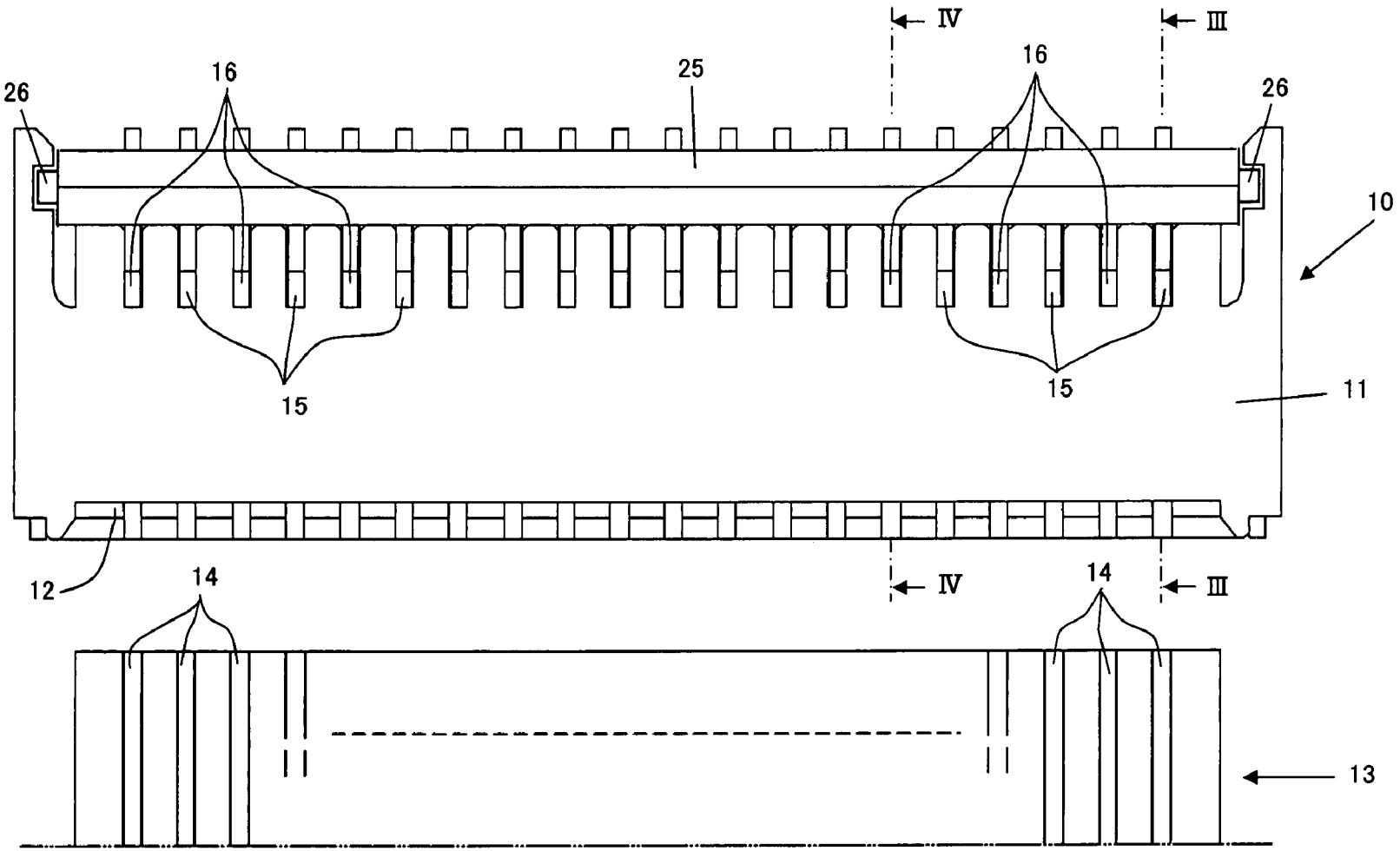
FIG. 2 is a schematic plane view showing the first embodiment shown in FIG. 1, together with the part of the flexible printed circuit board shown in FIG. 1 which is to be partially inserted into the first embodiment.

FIGS. 1 and 2 show a first embodiment of electrical connector according to the present invention, together with a part of a flexible printed circuit board which is to be partially inserted into the first embodiment.

Referring to FIGS. 1 and 2, an electrical connector 10, which constitutes the first embodiment of electrical connector according to the present invention, has a housing 11 made of insulator such as plastics or the like and provided with an opening 12 through which a circuit board is partially inserted into the housing 11. For example, a flexible printed circuit board 13 is partially inserted into the housing 11 through the opening 12. On a part of the flexible printed circuit board 13, which is inserted into the housing 11 through the opening 12, a plurality of connecting terminals 14 each made of conductive material and formed into a rectangular plate member are provided to be arranged. Each of the connecting terminals 14 is electrically connected with a conducting circuit pattern portion provided on the flexible printed circuit board 13, an illustration of which is omitted.

A plurality of conductive contacts 15 constituting first contacts and a plurality of conductive contacts 16 constituting second contacts are arranged alternately in the housing 11 of the electrical connector 10. Each of the conductive contacts 15 and 16 elongates in a direction along which the part of the flexible printed circuit board 13 is inserted into the housing 11 and drawn out of the housing 11 and is positioned to correspond to one of the connecting terminals 14 provided on the part of the flexible printed circuit board 13 when the flexible printed circuit board 13 is partially inserted into the housing 11 through the opening 12.

Figure 3:
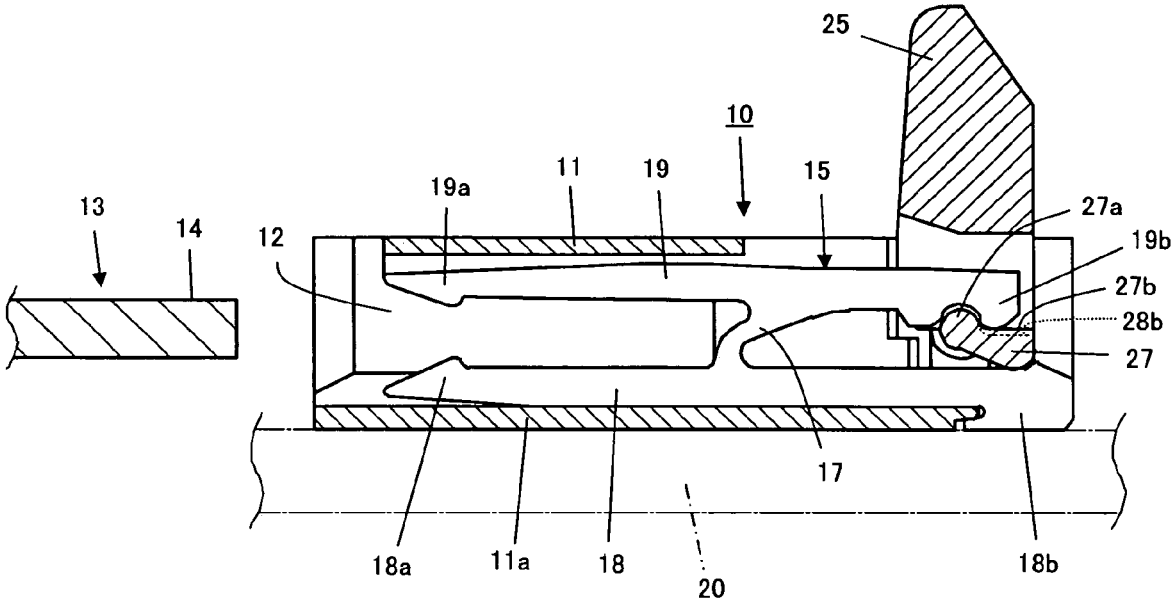
FIGS. 3, 4, 5 and 6 are schematic cross sectional views used for explaining the structure and operation of the first embodiment shown in FIGS. 1 and 2.

Each of the conductive contacts 15 constituting the first contacts is made of conductive resilient material and formed into an H-shaped plate member, as shown in FIG. 3 showing a cross section taken along a line III-III in FIG. 2. The conductive contact 15 has a pair of beams 18 and 19 coupled with each other through a connecting portion 17. The beam 18 constitutes a fixed part of the conductive contact 15 and the beam 19 constitutes a movable part of the conductive contact 15 serving as an operating part of the conductive contact 15. One end portion 18*a* of the beam 18 is disposed at the opening 12 provided on the housing 11 and the other end portion 18*b* of the beam 18 is electrically connected with a conducting circuit pattern portion provided on a main circuit board 20 on which the electrical connector 10 is mounted. An illustration of the conducting circuit pattern portion on the main circuit board 20 is omitted. An end portion 19*a* of the beam 19 is disposed at the opening 12 provided on the housing 11 to be opposite to the end portion 18*a* of the beam 18.

Figure 4:
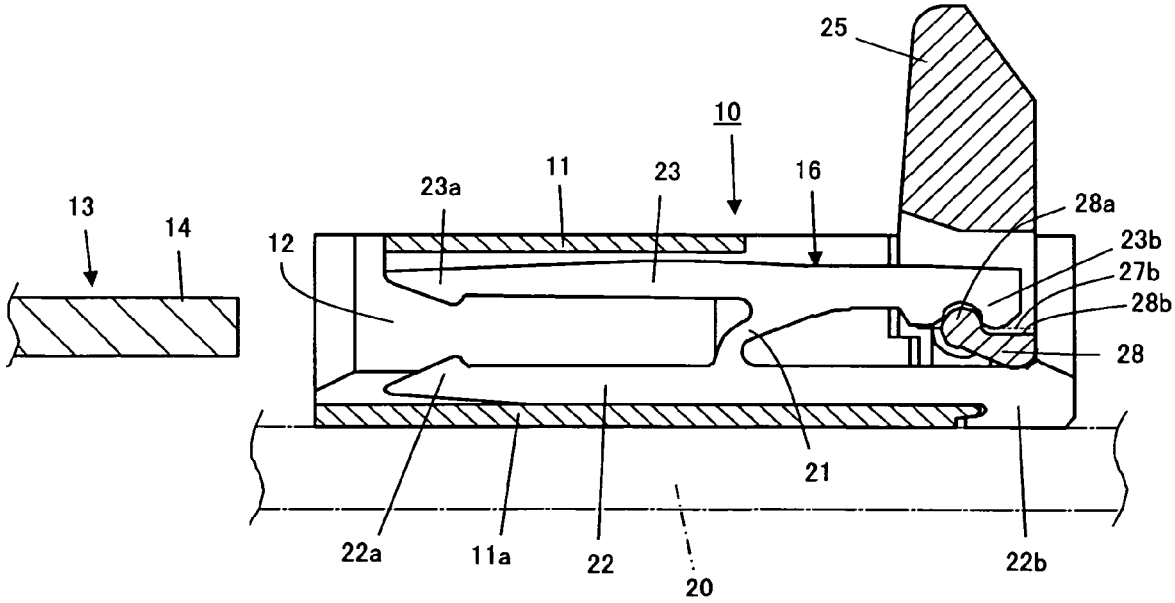

Each of the conductive contacts 16 constituting the second contacts is also made of conductive resilient material and formed into an H-shaped plate member in substantially the same manner as each of the conductive contacts 15, as shown in FIG. 4 showing a cross section taken along a line IV-IV in FIG. 2. The conductive contact 16 has a pair of beams 22 and 23 coupled with each other through a connecting portion 21. The beam 22 constitutes a fixed part of the conductive contact 16 and the beam 23 constitutes a movable part of the conductive contact 16 serving as an operating part of the conductive contact 16. One end portion 22*a* of the beam 22 is disposed in the opening 12 provided on the housing 11 and the other end portion 22*b* of the beam 22 is electrically connected with a conducting circuit pattern portion provided on the main circuit board 20 on which the electrical connector 10 is mounted. An illustration of the conducting circuit pattern portion on the main circuit board 20 is omitted. An end portion 23*a* of the beam 23 is also disposed in the opening 12 provided on the housing 11 to be opposite to the end portion 22*a* of the beam 22.

Figure 5:
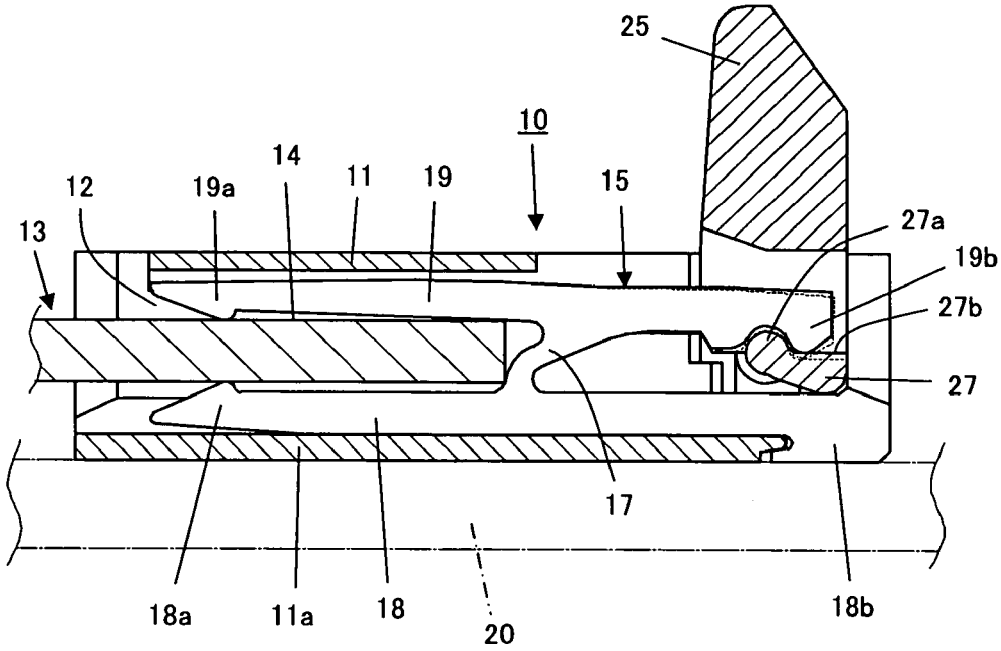
Figure 6:
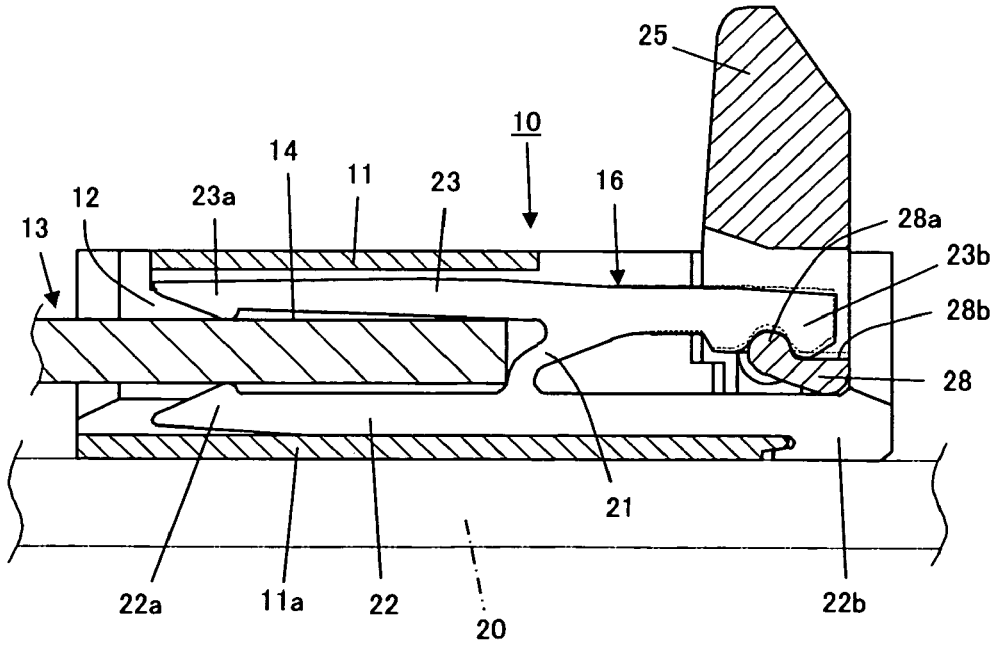

When the flexible printed circuit board 13 is partially inserted into the housing 11 through the opening 12, the part of the flexible printed circuit board 13 on which the connecting terminals 14 are provided to be arranged is placed between the beams 18 and 19 of each of the conductive contacts 15 and between the beams 22 and 23 of each of the conductive contacts 16 in the housing 11, as shown in FIGS. 5 and 6. Each of the conductive contacts 15 is designed to have a space between the beams 18 and 19, which is slightly smaller than the thickness of the part of the flexible printed circuit board when the part of the flexible printed circuit board 13 is not placed between the beams 18 and 19 of each of the conductive contacts 15. Further, each of the conductive contacts 16 is also designed to have a space between the beams 22 and 23, which is slightly smaller than the thickness of the part of the flexible printed circuit board 13 when the part of the flexible printed circuit board 13 is not placed between the beams 22 and 23 of each of the conductive contacts 16. The connecting terminals 14 provided on the part of the flexible printed circuit board 13 are positioned to correspond respectively to the conductive contacts 15 and 16 which are arranged alternately in the housing 11.

Further, the electrical connector 10 has an actuator 25 which is provided to be rotatable to the housing 11 and positioned at a side of the housing 11 opposite to another side of the housing 11 on which the opening 12 is provided, as shown in FIGS. 1 and 2. The actuator 25 is shaped into a long and narrow member elongating along the arrangement of the conductive contacts 15 and 16 and provided with rotary axes 26 at both its end portions in the longitudinal direction, as shown in FIG. 2. The rotary axes 26 are engaged with a pair of bearings provided on the housing 11, respectively, so that the actuator 25 is able to rotate in regard to the housing 11.

Figure 9:
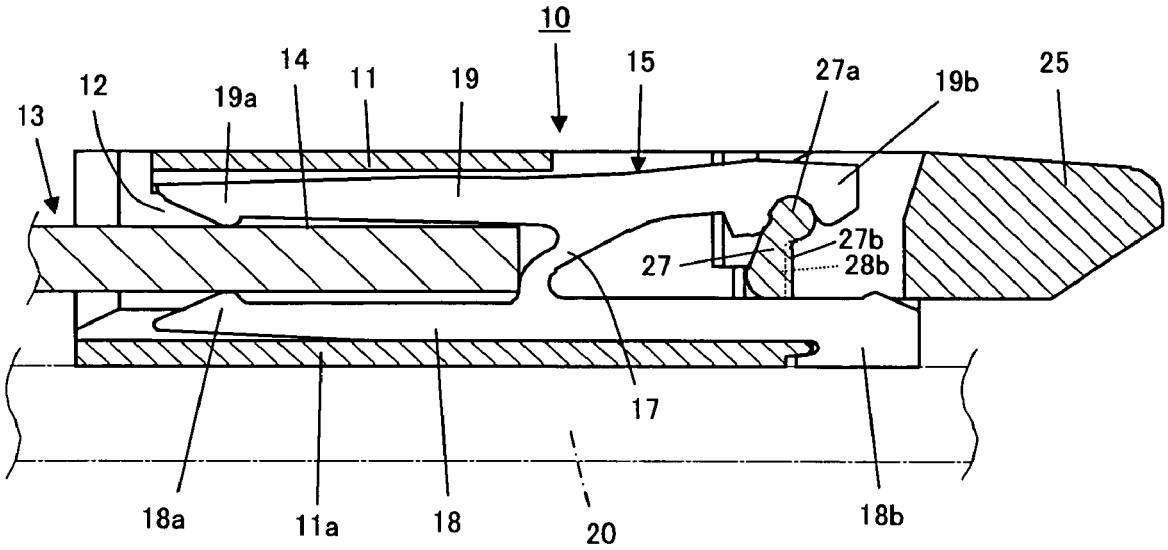
FIGS. 9 and 10 are schematic cross sectional views used for explaining the structure of an actuator provided in the first embodiment shown in FIGS. 1 and 2.
Figure 10:
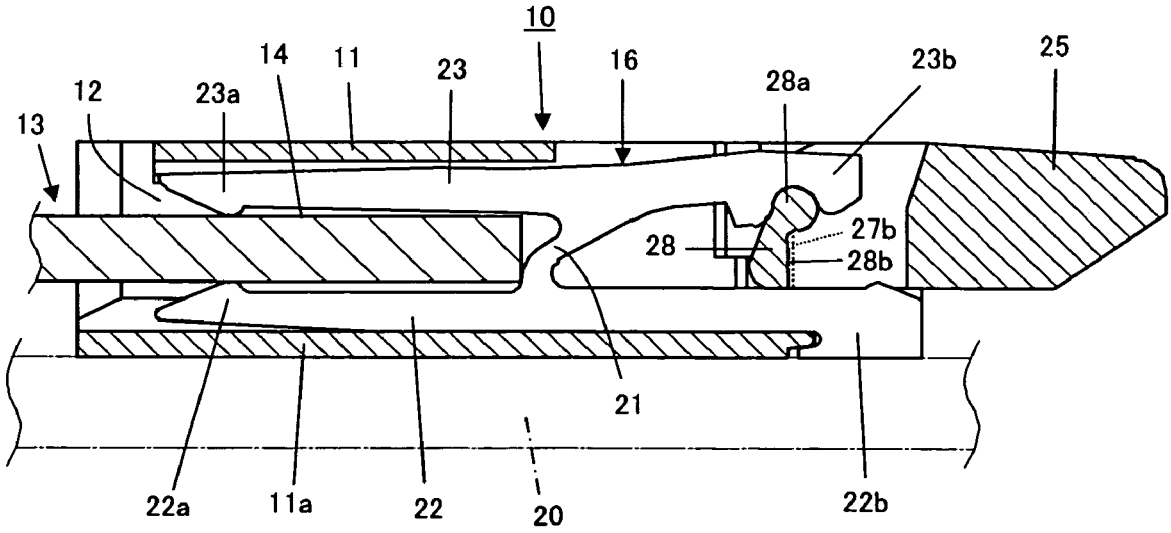

The actuator 25 is postured to take up first and second stations selectively. In the first station, the actuator 25 keeps rising from the housing 11, as shown in FIGS. 1, 2 and 3 to 6, and in the second station, the actuator 25 keeps lying down on the housing 11, as shown in FIGS. 9 and 10 described later. Then, the actuator 25 is rotated to shift from the first station to the second station or from the second station to the first station.

The actuator 25 has a plurality of cams 27 each engaging with another end portion 19*b* of the beam 19 of one of the conductive contact 15, as shown in FIG. 3. Each of the cams 27 has a first engaging portion 27*a* and a second engaging portion 27*b* and moves with the rotating movement of the actuator 25.

Figure 7:
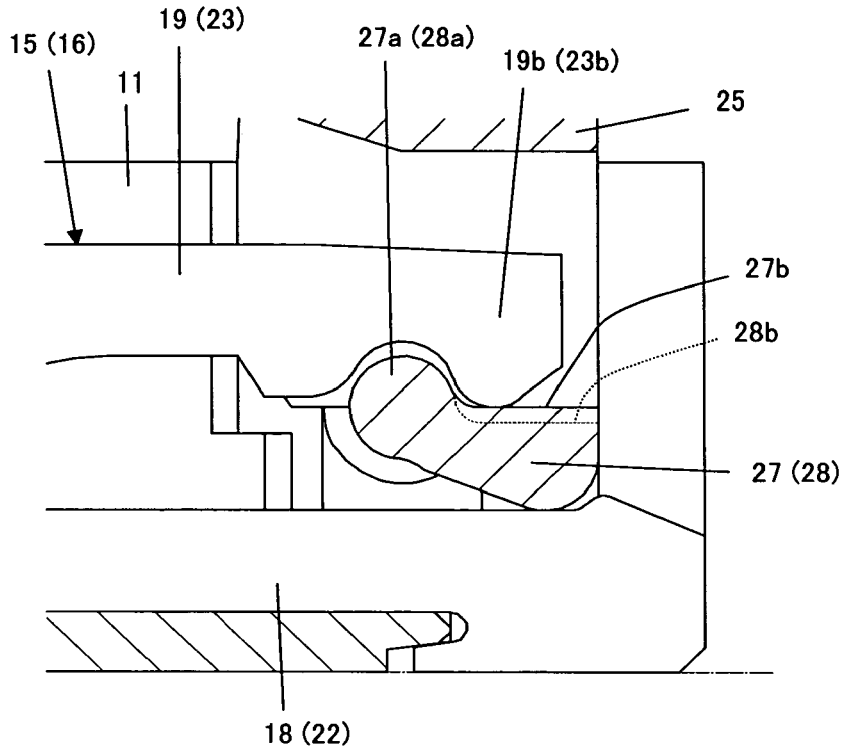
FIGS. 7 and 8 are fragmentary enlarged cross sectional views used for explaining the structure and operations of the first embodiment shown in FIGS. 1 and 2.

The cam 27 is operative to cause the second engaging portion 27*b* to come into contact with the end portion 19*b* of the beam 19 of the conductive contact 15 corresponding thereto, as shown in FIG. 3 and shown with solid lines in FIG. 7, when the actuator 25 is postured to take the first station and the flexible printed circuit board 13 is not inserted into the housing 11. In this occasion, the second engaging portion 27*b* of the cam 27 does not operate to exert an effective pushing force to the beam 19 of the conductive contact 15 but is operative to prevent the beam 19 of the conductive contact 15 from moving downward in FIG. 3 or 7.

The actuator 25 has also a plurality of cams 28 each engaging with another end portion 23*b* of the beam 23 of one of the conductive contacts 16, as shown in FIG. 4, in addition to the cams 27. Each of the cams 28 has a first engaging portion 28*a* and a second engaging portion 28*b* and moves with the rotating movement of the actuator 25.

The cam 28 is operative to cause the second engaging portion 28*b* to be in noncontact with the end portion 23*b* of the beam 23 of the conductive contact 16 corresponding thereto, as shown in FIG. 4 and shown in enlargement with solid and broken lines in FIG. 7, when the actuator 25 is postured to take the first station and the flexible printed circuit board 13 is not inserted into the housing 11. In this occasion, a relatively small space is formed between the second engaging portion 28*b* of the cam 28 and the end portion 23*b* of the beam 23 of the conductive contact 16 and therefore the end portion 23*b* of the beam 23 is able to move downward in FIG. 4 or 7. That is, the second engaging portion 28*b* of the cams 28 is different in shape from the second engaging portion 27*b* of the cams 27. This means that each of the cams 27 and each of the cams 28 are different in shape from each other.

The cams 27 and the cams 28 are provided to correspond respectively to the conductive contacts 15 and the conductive contacts 16 arranged alternately in the housing 11. Therefore, the cams 27 and the cams 28 are also arranged alternately on the actuator 25 in the longitudinal direction of the same. Since each of the conductive contacts 15 and 16 is formed in the same shape, the space between the beams 18 and 19 of each of the conductive contacts 15 is substantially the same as the space between the beams 22 and 23 of each of the conductive contacts 16, so that a space between the beam 19 of each of the conductive contacts 15 and a board-shaped portion 11*a* of the housing 11 with which the beam 18 of each of the conductive contacts 15 engages is substantially the same as a space between the beam 23 of each of the conductive contacts 16 and the board-shaped portion 11*a* of the housing 11 with which the beam 22 of each of the conductive contacts 16 engages.

Under such a situation, when the flexible printed circuit board 13 is partially inserted into the housing 11 through the opening 12 provided thereon, the part of the flexible printed circuit board 13 inserted into the housing 11 is placed between the beams 18 and 19 of each of the conductive contacts 15 and between the beams 22 and 23 of each of the conductive contacts 16 in the housing 11, as shown in FIGS. 5 and 6. The end portion 18*a* of the beam 18 of each of the conductive contacts 15 and the end portion 22*a* of the beam 22 of each of the conductive contacts 16 come into contact with one surface of the part of the flexible printed circuit board 13, which is opposite to the other surface of the part of the flexible printed circuit board 13 on which the connecting terminals 14 are provided. The end portion 19*a* of the beam 19 of each of the conductive contacts 15 and the end portion 23*a* of the beam 23 of each of the conductive contacts 16 come into contact respectively with corresponding ones of the connecting terminals 14 provided on the part of the flexible printed circuit board 13.

Figure 8:
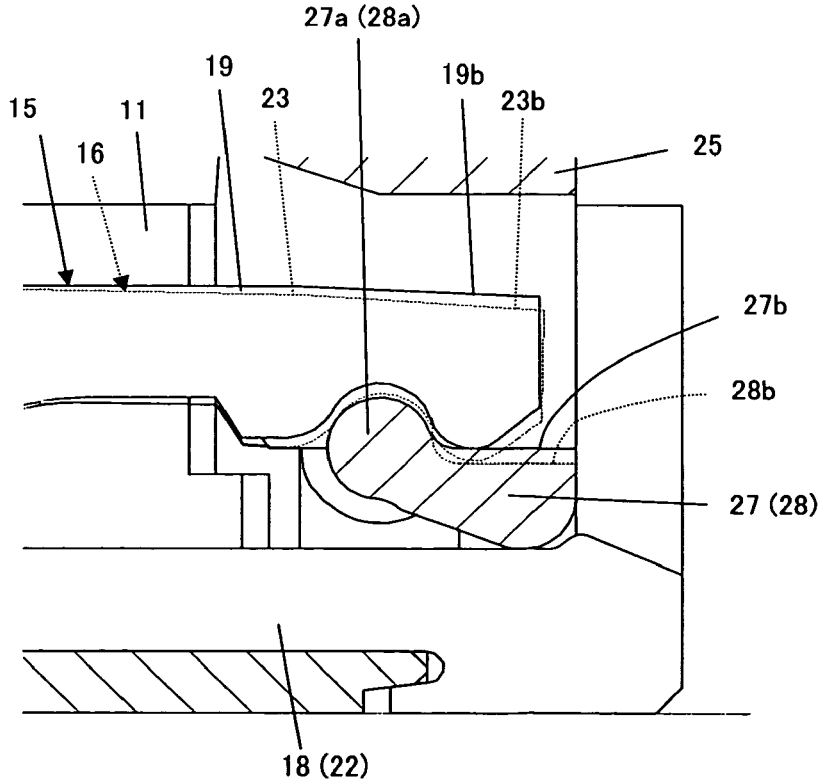

The end portion 19*a* of the beam 19 of each of the conductive contacts 15, which comes into contact with the corresponding connecting terminals 14, is slightly pushed upward in FIG. 5 by the part of the flexible printed circuit board 13 and thereby the beam 19 is put in a condition for having a small angular motion in the clockwise direction in FIG. 5 so as to push the end portion 19*b* thereof downward in FIG. 5. However, as shown in FIG. 5 and shown in enlargement with the solid lines in FIG. 8, the end portion 19*b* of the beam 19 of each of the conductive contacts 15 is prevented from moving downward in FIG. 5 or 8 by the second engaging portion 27*b* of the cam 27 which is in contact with the end portion 19*b* of the beam 19. Accordingly, in practice, the beam 19 of each of the conductive contacts 15 does not have any angular motion in the clockwise direction in FIG. 5 nor push the end portion 19*b* thereof downward in FIG. 5 and the end portion 19*b* of the beam 19 receives a retroactive force from the second engaging portion 27*b* of the cam 27. Then, the beam 19 of each of the conductive contacts 15 is operative to transfer the retroactive force from the second engaging portion 27*b* of the cam 27 to the part of the flexible printed circuit board 13 through the end portion 19*a* of the beam 19.

As a result, the beam 19 of each of the conductive contact 15 is put in a condition in which the end portion 19*a* of the beam 19 is operative to push the part of the flexible printed circuit board 13 inserted into the housing 11 downward in FIG. 5 with a pushing force corresponding to the retroactive force which the end portion 19*b* of the beam 19 receives from the second engaging portion 27*b* of the cam 27, so as to hold temporarily the flexible printed circuit board 13. That is, the beam 19 of each of the conductive contact 15 is operative to exert to the part of the flexible printed circuit board 13 inserted into the housing 11 a temporary holding force corresponding to the retroactive force which the end portion 19*b* of the beam 19 receives from the second engaging portion 27*b* of the cam 27.

The end portion 23*a* of the beam 23 of each of the conductive contacts 16, which comes into contact with the corresponding connecting terminal 14 provided on the part of the flexible printed circuit board 13 inserted into the housing 11, is also slightly pushed upward in FIG. 6 by the part of the flexible printed circuit board 13 and thereby the beam 23 is put in a condition for having a small angular motion in the clockwise direction in FIG. 6 so as to push the end portion 23*b* thereof downward in FIG. 6. Since the relatively small space is formed between the second engaging portion 28*b* of the cam 28 and the end portion 23*b* of the beam 23 of each of the conductive contacts 16, as shown in FIG. 4 and shown in enlargement with the solid and broken lines in FIG. 7, the end portion 23*b* of the beam 23 of each of the conductive contacts 16 is able to move downward in FIG. 6 or 8 up to come into contact with the second engaging portion 28*b* of the cam 28, as shown in FIG. 6 and shown in enlargement with solid and broken lines in FIG. 8. Accordingly, the beam 23 of each of the conductive contacts 16 is operative to have the small angular motion in the clockwise direction so as to push the end portion 23*b* thereof downward in FIG. 6.

As a result, the beam 23 of each of the conductive contacts 16 is put in a condition in which the end portion 23*a* of the beam 23 is operative to exert an extremely small pushing force or substantially not to exert any pushing force to the part of the flexible printed circuit board 13 inserted into the housing 11 so as not to hold temporarily the flexible printed circuit board 13 substantially. That is, the beam 23 of each of the conductive contacts 16 is operative to exert an extremely small temporary holding force or substantially not to exert any temporary holding force to the part of the flexible printed circuit board 13 inserted into the housing 11.

As described above, when the actuator 25 is postured to take the first station and the flexible printed circuit board 13 is partially inserted into the housing 11, each of the conductive contacts 15 is operative to exert the temporary holding force to the part of the flexible printed circuit board 13 inserted into the housing 11 so as to hold temporary the same and each of the conductive contacts 16 is operative to exert the extremely small temporary holding force or substantially not to exert any temporary holding force to the part of the flexible printed circuit board 13 inserted into the housing 11. As a result, only each of the conductive contacts 15 is substantially operative to exert the part of the flexible printed circuit board 13 inserted into the housing 11 the temporary holding force effective practically for holding the flexible printed circuit board 13 (an effective temporary holding force).

The amount of the temporary holding force exerted by the conductive contacts 15 to the part of the flexible printed circuit board 13 inserted into the housing 11 is in proportion to the number of the conductive contacts 15. Therefore, the effective temporary holding force acting on the part of the flexible printed circuit board 13 inserted into the housing 11 can be controlled to be appropriate by selecting suitably the number of the conductive contacts 15.

Under such a situation that the actuator 25 is postured to take the first station and the flexible printed circuit board 13 is partially inserted into the housing 11 through the opening 12 provided thereon, when the actuator 25 is rotated to shift from the first station to the second station, as shown in FIGS. 9 and 10, the beam 19 of each of the conductive contacts 15 and the beam 23 of each of the conductive contacts 16 are brought into press-contact with corresponding ones of the connecting terminals 14 provided on the part of the flexible printed circuit board 13 inserted into the housing 11, respectively, so as to hold securely the flexible printed circuit board 13.

With the rotating movement of the actuator 25 from the first station toward the second station, the cams 27 and the cams 28 provided alternately on the actuator 25 are rotated to cause the first and second engaging portions 27*a* and 27*b* of the cam 27 and the first and second engaging portions 28*a* and 28*b* of the cam 28 to vary in position.

Figure 11:
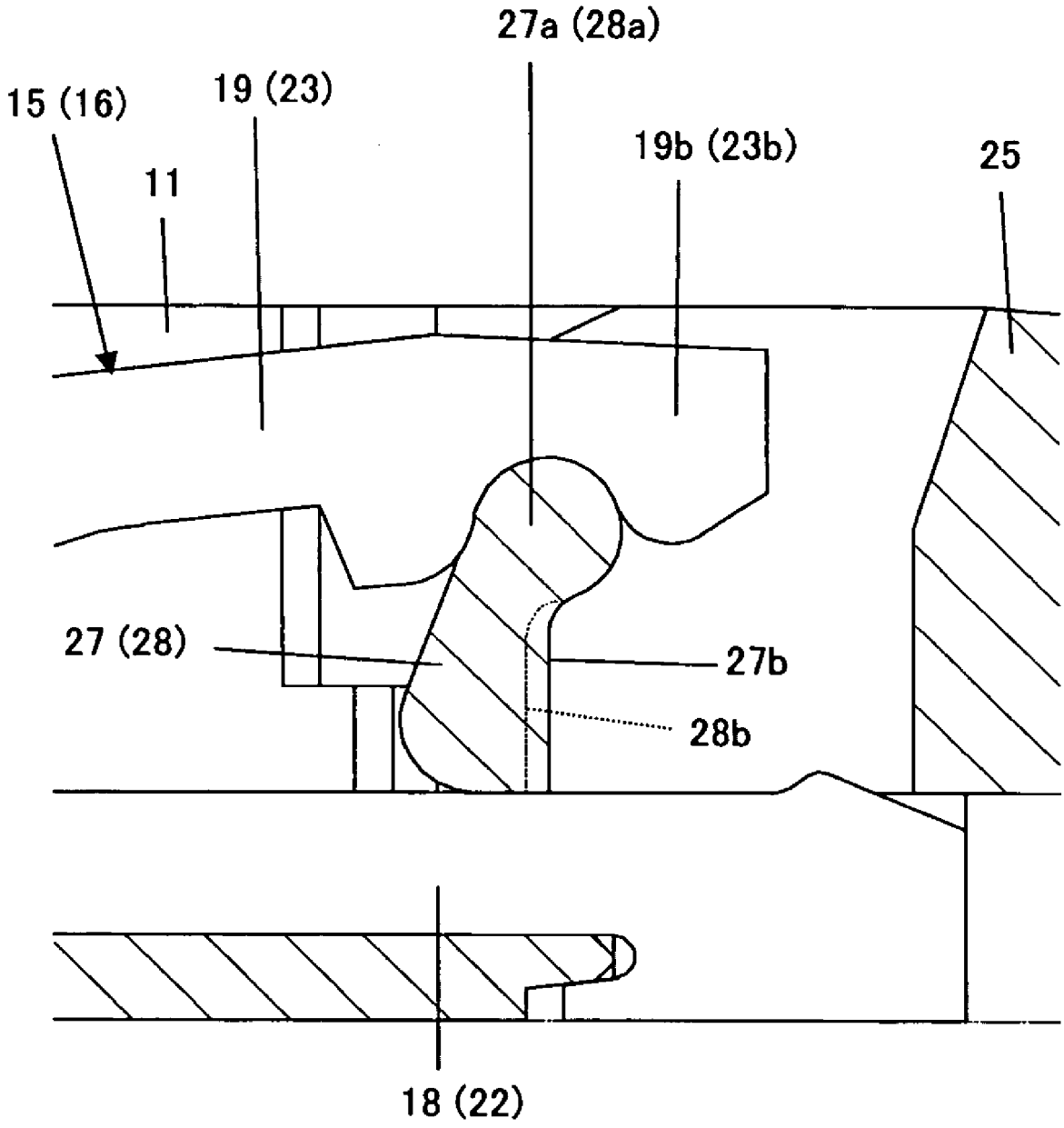
FIG. 11 is a fragmentary enlarged cross sectional view used for explaining the structure and operations of the first embodiment shown in FIGS. 1 and 2.

In such operations, as shown in FIG. 9 and shown in enlargement with solid lines in FIG. 11, the first engaging portion 27*a* of each of the cams 27 engages with a dent provided on the end portion 19*b* of the beam 19 of one of the conductive contacts 15 and moves slightly the end portion 19*b* of the beam 19 upward in FIG. 9 or 11. Thereby, each of the cams 27 is operative to cause the end portion 19*a* of the beam 19 of one of the conductive contacts 15 to come into press-contact with the corresponding one of the connecting terminals 14 provided on the part of the flexible printed circuit board 13 inserted into the housing 11 so as to hold securely the flexible printed circuit board 13. On that occasion, the part of the flexible printed circuit board 13 on which the connecting terminals 14 are provided is put between the end portion 19*a* of the beam 19 and the end portion 18*a* of the beam 18 of each of the conductive contacts 15.

Further, as shown in FIG. 10 and shown in enlargement with solid and broken lines in FIG. 11, the first engaging portion 28*a* of each of the cams 28 engages with a dent provided on the end portion 23*b* of the beam 23 of one of the conductive contacts 16 and moves slightly the end portion 23*b* of the beam 23 upward in FIG. 10 or 11. Thereby, each of the cams 28 is operative to cause the end portion 23*a* of the beam 23 of one of the conductive contacts 16 to come into press-contact with the corresponding one of the connecting terminals 14 provided on the part of the flexible printed circuit board 13 inserted into the housing 11 so as to hold securely the flexible printed circuit board 13. On that occasion, the part of the flexible printed circuit board 13 on which the connecting terminals 14 are provided is put between the end portion 23*a* of the beam 23 and the end portion 22*a* of the beam 22 of each of the conductive contacts 16.

Under the situation in which the flexible printed circuit board 13 is partially inserted into the housing 11 and held by the conductive contacts 15 and 16, the actuator 25 postured to take the second station, as shown in FIGS. 9 and 10, is rotated to sift from the second station to the first station, as occasion demands. The rotating movement of the actuator 25 for shifting from the second station toward the first station is opposite in direction to that for shifting from the first station toward the second station.

The actuator 25 in the rotating movement for shifting from the second station toward the first station operates to cause each of the conductive contacts 15 and 16 to get out of press-contact with the corresponding one of the connecting terminals 14 provided on the part of the flexible printed circuit board 13 so that the flexible printed circuit board 13 is loosened from holding by the conductive contacts 15 and 16. In this operation, with the rotating movement of the actuator 25 from the second station toward the first station, the first engaging portion 27*a* of each of the cams 27 disengages from the dent provided on the end portion 19*b* of the beam 19 of one of the conductive contacts 15 and the second engaging portion 27*b* of each of the cams 27 comes into contact with the end portion 19*b* of the beam 19 of one of the conductive contacts 15. Further, the first engaging portion 28*a* of each of the cams 28 disengages from the dent provided on the end portion 23*b* of the beam 23 of one of the conductive contacts 16 and the second engaging portion 28*b* of each of the cams 28 takes such a position that the relatively small space is formed between the second engaging portion 28*b* of the cam 28 and the end portion 23*b* of the beam 23 of the conductive contact 16.

Although, in the above described electrical connector 10, which constitutes the first embodiment of electrical connector according to the present invention, the conductive contacts 15 and 16 are arranged alternately in the housing 11, it is not always necessary for the electrical connector according to the present invention that the conductive contacts 15 and 16 are arranged alternately in the housing 11. For example, it is possible to dispose the conductive contacts 15 at both end portions of the arrangement of the conductive contacts 15 and 16, at both end portions and a central portion of the arrangement of the conductive contacts 15 and 16, or at intervals of a predetermined number of the conductive contacts 16, so that the conductive contacts 16 are arranged between a couple of conductive contacts 15. In such a case, the arrangement of the cams 27 corresponding to the conductive contacts 15 respectively and the cams 28 corresponding to the conductive contacts 16 respectively on the actuator 25 is also set to correspond to the arrangement of the conductive contacts 15 and 16.

Further, although, in the above described electrical connector 10, which constitutes the first embodiment of electrical connector according to the present invention, two kinds of cams which are the cams 27 and 28 are provided on the actuator 25 and each of the cams 27 and each of the cams 28 are different in shape with each other, it is also possible to provide the actuator 25 with more than two kinds of cams different in shape. In such a case, the actuator 25 is operative to exert to the part of the flexible printed circuit board 13 inserted into the housing 11 a temporary holding force divided into more than two grades in intensity.

FIGS. 12 to 23 show a second embodiment of electrical connector according to the present invention, together with a part of a flexible printed circuit board inserted into the first embodiment.

Referring to FIGS. 12 to 23, an electrical connector 30, which constitutes the second embodiment of electrical connector according to the present invention, has various parts and portions corresponding to those in the above described first embodiment shown in FIGS. 1 to 11, which are marked with the same references, and further description thereof will be omitted.

The electrical connector 30 corresponds to a modification of the electrical connector 10, in which the conductive contacts 15 and 16 are replaced with conductive contacts 31 and 32 and the cams 27 and 28 provided on the actuator 25 are replaced with cams 40 provided also on an actuator 25. Each of the conductive contacts 31 is different in partial shape from each of the conductive contacts 32 and each of the cams 40 is formed into the same shape.

The electrical connector 30 is attached to a main circuit board 20 in the same manner as the electrical connector 10 shown in FIGS. 1 to 11. A part of a flexible printed circuit board 13 is inserted into a housing 11 of the electrical connector 30 through an opening 12 provided thereon. On the part of the flexible printed circuit board 13, which is inserted into the housing 11 through the opening 12, a plurality of connecting terminals 14 are provided to be arranged.

A plurality of conductive contacts 31 which correspond to the conductive contacts 15 in the electrical connector 10 aforementioned and a plurality of conductive contacts 32 which correspond to the conductive contacts 16 in the electrical connector 10 aforementioned are arranged alternately in the housing 11 of the electrical connector 30. Each of the conductive contacts 31 and 32 elongates in a direction along which the part of the flexible printed circuit board 13 is inserted into the housing 11 and drawn out of the housing 11 and is positioned to correspond to one of the connecting terminals 14 provided on the part of the flexible printed circuit board 13 when the flexible printed circuit board 13 is partially inserted into the housing 11 through the opening 12.

Figure 12:
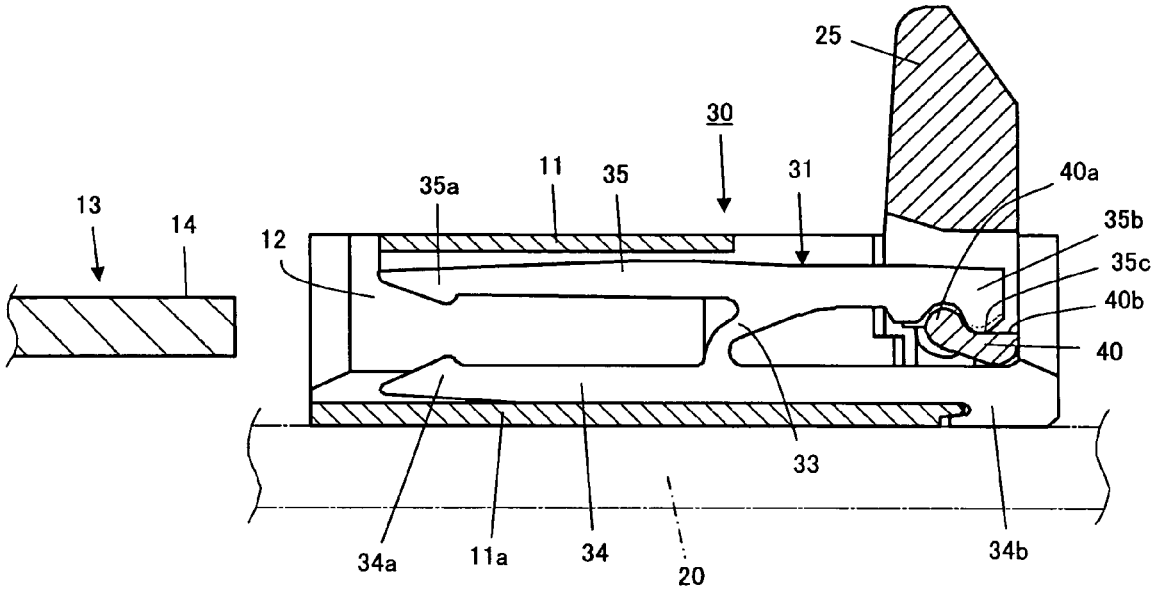
FIGS. 12 and 13 are schematic cross sectional views used for explaining the structure and operations of a second embodiment of electrical connector according to the present invention.

Each of the conductive contacts 31 is made of conductive resilient material and formed into an H-shaped plate member, as shown in FIG. 12. The conductive contact 31 has a pair of beams 34 and 35 coupled with each other through a connecting portion 33. The beam 34 constitutes a fixed part of the conductive contact 31 and the beam 35 constitutes a movable part of the conductive contact 31 serving as an operating part of the conductive contact 31. The beam 34 constituting the fixed part of the conductive contact 31 engages with a board-shaped portion 11*a* of the housing 11. An end portion 34*a* of the beam 34 is positioned at a side of the housing 11 on which the opening 12 is provided and another end portion 34*b* of the beam 34 is electrically connected with a conducting circuit pattern portion provided on the main circuit board 20 on which the electrical connector 30 is mounted. An illustration of the conducting circuit pattern portion on the main circuit board 20 is omitted. An end portion 35*a* of the beam 35 constituting the operating part of the conductive contact 31 is positioned at the side of the housing 11 on which the opening 12 is provided to be opposite to the end portion 34*a* of the beam 34 and another end portion 35*b* of the beam 35 is provided with an engaging projection 35*c* and positioned to be opposite to the end portion 34*b* of the beam 34.

Figure 13:
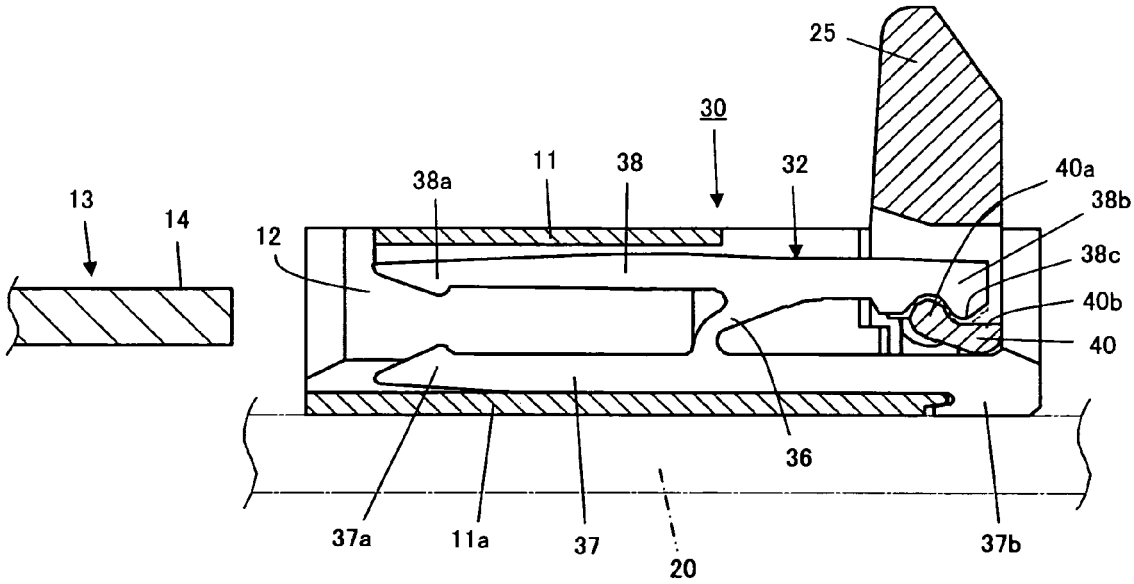

Each of the conductive contacts 32 is also made of conductive resilient material and formed into an H-shaped plate member, as shown in FIG. 13. The conductive contact 32 has a pair of beams 37 and 38 coupled with each other through a connecting portion 36. The beam 37 constitutes a fixed part of the conductive contact 32 and the beam 38 constitutes a movable part of the conductive contact 32 serving as an operating part of the conductive contact 32. The beam 37 constituting the fixed part of the conductive contact 32 engages with the board-shaped portion 11*a* of the housing 11. An end portion 37*a* of the beam 37 is positioned at the side of the housing 11 on which the opening 12 is provided and another end portion 37*b* of the beam 37 is electrically connected with the conducting circuit pattern portion provided on the main circuit board 20 on which the electrical connector 30 is mounted. An end portion 38*a* of the beam 38 constituting the operating part of the conductive contact 32 is positioned at the side of the housing 11 on which the opening 12 is provided to be opposite to the end portion 37*a* of the beam 37 and another end portion 38*b* of the beam 38 is provided with an engaging projection 38*c* and positioned to be opposite to the end portion 37*b* of the beam 37.

Figure 14:
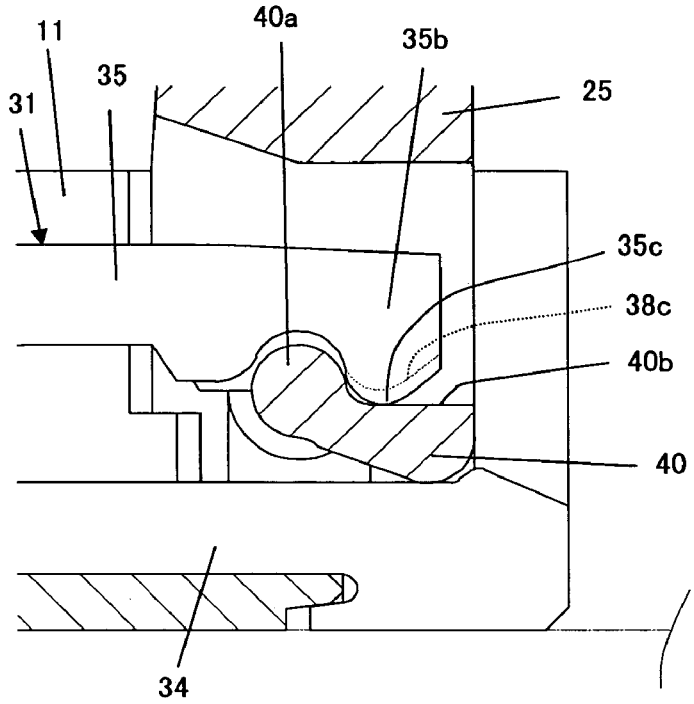
FIGS. 14 and 15 are fragmentary enlarged cross sectional views used for explaining the structure and operations of the second embodiment shown in FIGS. 12 and 13.
Figure 15:
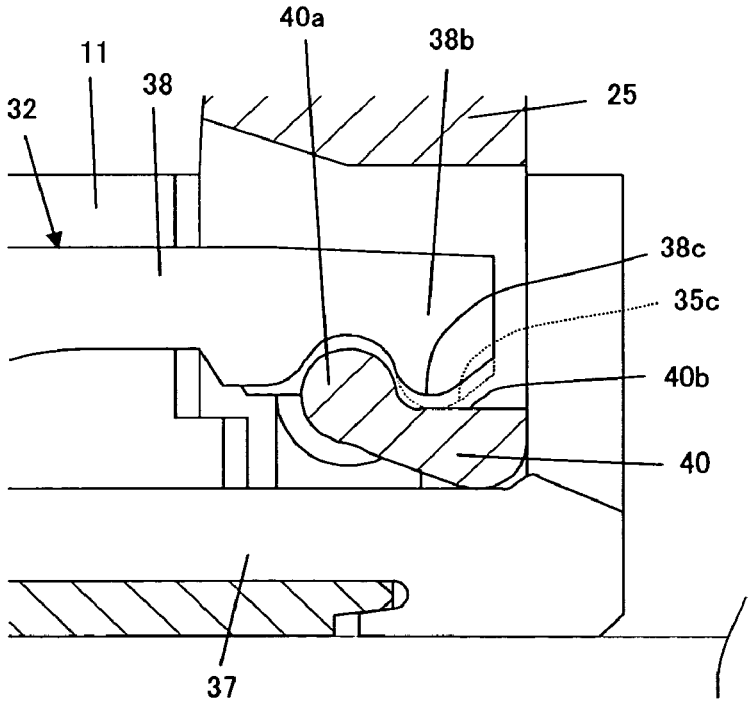

The engaging projection 35*c* provided on the end portion 35*b* of the beam 35 of each of the conductive contacts 31 is different in shape from the engaging projection 38*c* provided on the end portion 38*b* of the beam 38 of each of the conductive contacts 32, as shown in enlargement in FIGS. 14 and 15. Portions other than the engaging projection 35*c* of the beam 35 of each of the conductive contacts 31 are formed in the same shape as portions other than the engaging projection 38*c* of the beam 38, and therefore, a space between the beams 34 and 35 of each of the conductive contacts 31 is substantially the same as a space between the beams 37 and 38 of each of the conductive contacts 32 when the flexible printed circuit board 13 is not inserted into the housing 11, so that a space between the beam 35 of each of the conductive contacts 31 and the board-shaped portion 11*a* of the housing 11 with which the beam 34 of each of the conductive contacts 31 engages is substantially the same as a space between the beam 38 of each of the conductive contacts 32 and the board-shaped portion 11*a* of the housing 11 with which the beam 37 of each of the conductive contacts 32 engages.

When the flexible printed circuit board 13 is partially inserted into the housing 11 through the opening 12 provided thereon, the part of the flexible printed circuit board 13 on which the connecting terminals 14 are provided is placed between the beams 34 and 35 of each of the conductive contacts 31 and between the beams 37 and 38 of each of the conductive contacts 32 in the housing 11. The connecting terminals 14 provided on part of the flexible printed circuit board 13 are positioned to correspond respectively to the conductive contacts 31 and 32 which are arranged alternately in the housing 11.

Further, as shown in FIGS. 12 to 17, the actuator 25, which is provided to be rotatable to the housing 11 and positioned at a side of the housing 11 opposite to another side of the housing 11 on which the opening 12 is provided, has a plurality of cams 40 engaging with the end portion 35*b* of the beam 35 of each of the conductive contacts 31 and the end portion 38*b* of the beam 38 of each of the conductive contacts 32. Each of the cams 40 is formed in the same shape to have a first engaging portion 40*a* and a second engaging portion 40*b*. The cams 40 are arranged on the actuator 25 to correspond to the conductive contacts 31 and 32, respectively, and move with the rotating movement of the actuator 25.

As shown in FIG. 12 and shown in enlargement in FIG. 14, the engaging projection 35*c* provided on the end portion 35*b* of the beam 35 of each of the conductive contacts 31 is in contact with the second engaging portion 40*b* of the cam 40 so as to be prevented by the second engaging portion 40*b* of the cam 40 from moving downward in FIG. 12 or 14 when the actuator 25 is postured to take the first station and the flexible printed circuit board 13 is not inserted into the housing 11. Further, as shown in FIG. 13 and shown in enlargement in FIG. 15, the engaging projection 38*c* provided on the end portion 38*b* of the beam 38 of each of the conductive contacts 32 is in noncontact with the second engaging portion 40*b* of the cam 40 so that a relatively small space is formed between the engaging projection 38*c* and the second engaging portion 40*b* of the cam 40 when the actuator 25 is postured to take the first station and the flexible printed circuit board 13 is not inserted into the housing 11. Therefore, the engaging projection 38*c* provided on the end portion 38*b* of the beam 38 of each of the conductive contacts 32 is able to move downward in FIG. 13 or 15 up to come into contact with the second engaging portion 40*b* of the cam 40.

Figure 16:
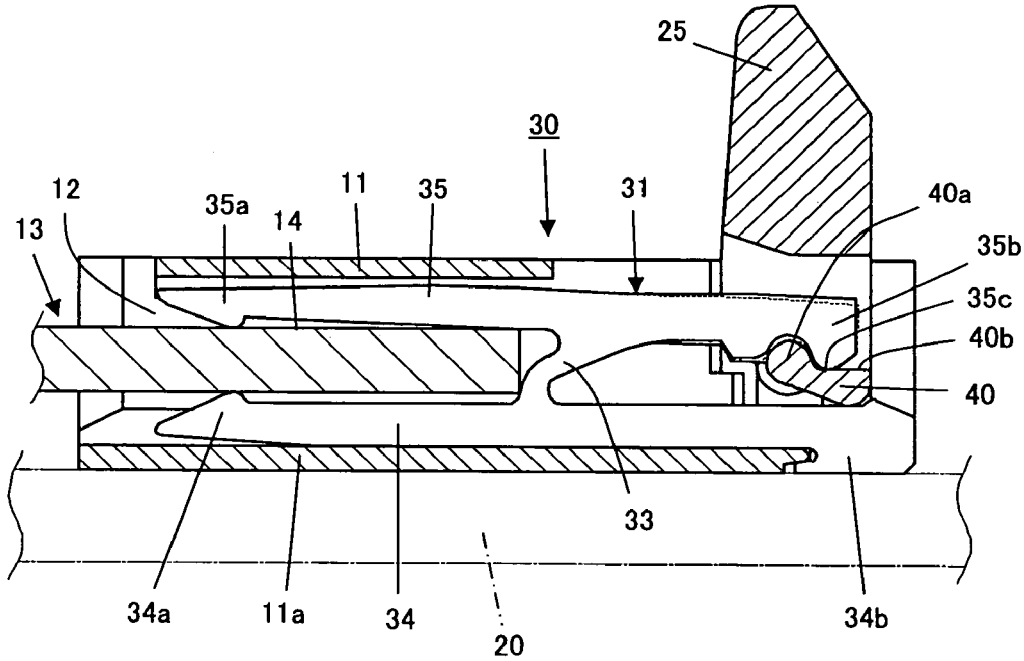
FIGS. 16 and 17 are schematic cross sectional views used for explaining the structure and operations of the second embodiment shown in FIGS. 12 and 13.
Figure 17:
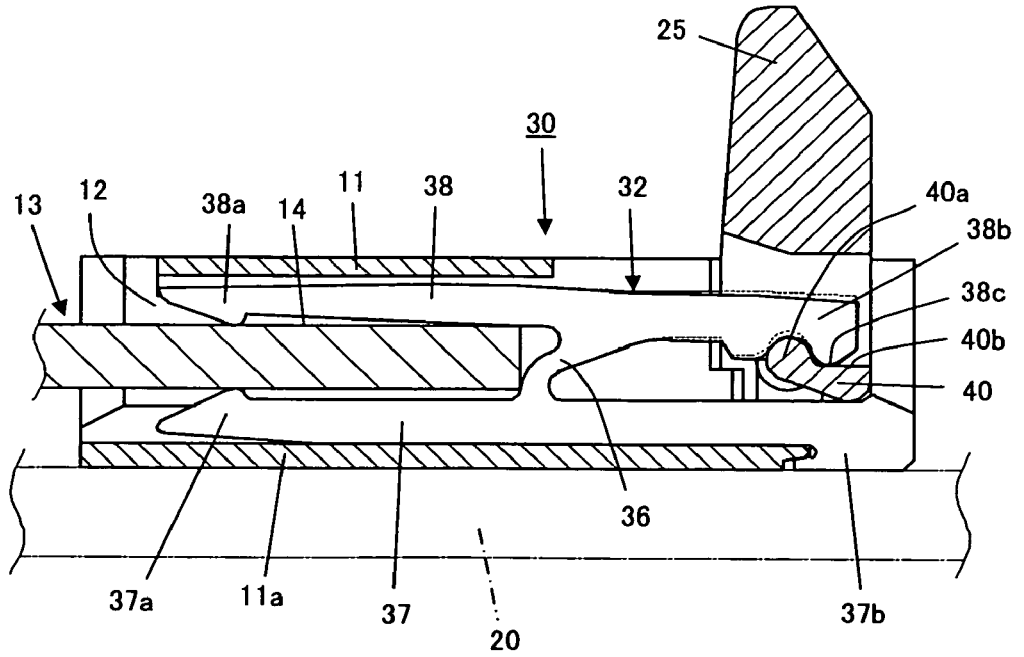
Figure 18:
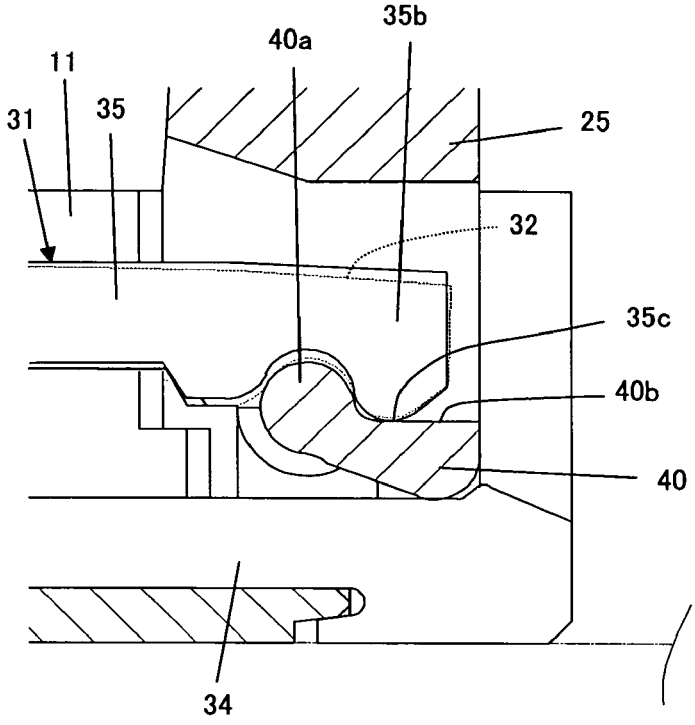
FIGS. 18 and 19 are fragmentary enlarged cross sectional views used for explaining the structure and operations of the second embodiment shown in FIGS. 12 and 13.
Figure 19:
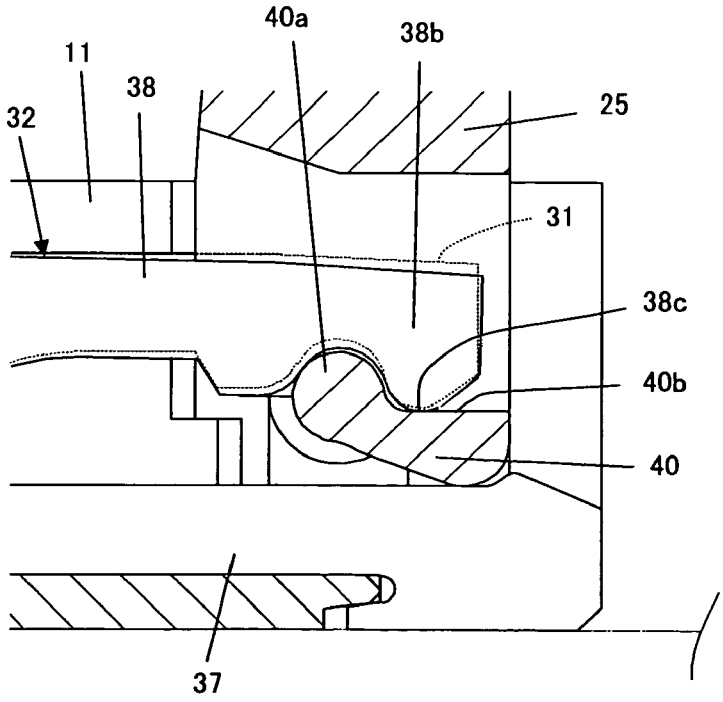

Then, when the flexible printed circuit board 13 is partially inserted into the housing 11 through the opening 12 provided thereon, the part of the flexible printed circuit board 13 inserted into the housing 11 is placed between the beams 34 and 35 of each of the conductive contacts 31 and between the beams 37 and 38 of each of the conductive contacts 32 in the housing 11, as shown in FIGS. 16 and 17. The end portion 34*a* of the beam 34 of each of the conductive contacts 31 and the end portion 37*a* of the beam 37 of each of the conductive contacts 32 come into contact with one surface of the part of the flexible printed circuit board 13, which is opposite to the other surface of the part of the flexible printed circuit board 13 on which the connecting terminals 14 are provided. The end portion 35*a* of the beam 35 of each of the conductive contacts 31 and the end portion 38*a* of the beam 38 of each of the conductive contacts 32 come into contact respectively with corresponding ones of the connecting terminals 14 provided on the part of the flexible printed circuit board 13.

The end portion 35*a* of the beam 35 of each of the conductive contacts 31, which comes into contact with the corresponding connecting terminals 14, is slightly pushed upward in FIG. 16 by the part of the flexible printed circuit board 13 and thereby the beam 35 is put in a condition for having a small angular motion in the clockwise direction in FIG. 16 so as to push the engaging projection 35*c* provided on the end portion 35*b* thereof downward in FIG. 16. However, as shown in FIG. 16 and shown in enlargement in FIG. 18, the engaging projection 35*c* provided on the end portion 35*b* of the beam 35 of each of the conductive contacts 31 is prevented from moving downward in FIG. 16 or 18 by the second engaging portion 40*b* of the cam 40 which is in contact with the engaging projection 35*c*. Accordingly, in practice, the beam 35 of each of the conductive contacts 31 does not have any angular motion in the clockwise direction in FIG. 16 nor push the engaging projection 35*c* provided on the end portion 35*b* thereof downward in FIG. 16 and the engaging projection 35*c* provided on the end portion 35*b* of the beam 35 receives a retroactive force from the second engaging portion 40*b* of the cam 40. Then, the beam 35 of each of the conductive contacts 31 is operative to transfer the retroactive force from the second engaging portion 40*b* of the cam 40 to the part of the flexible printed circuit board 13 through the end portion 35*a* of the beam 35.

As a result, the beam 35 of each of the conductive contacts 31 is put in a condition in which the end portion 35*a* of the beam 35 is operative to push the part of the flexible printed circuit board 13 inserted into the housing 11 downward in FIG. 16 with a pushing force corresponding to the retroactive force which the engaging projection 35*c* provided on the end portion 35*b* of the beam 35 receives from the second engaging portion 40*b* of the cam 40, so as to hold temporarily the flexible printed circuit board 13. That is, the beam 35 of each of the conductive contacts 31 is operative to exert to the part of the flexible printed circuit board 13 inserted into the housing 11 a temporary holding force corresponding to the retroactive force which the engaging projection 35*c* provided on the end portion 35*b* of the beam 35 receives from the second engaging portion 40*b* of the cam 40.

The end portion 38*a* of the beam 38 of each of the conductive contacts 32, which comes into contact with the corresponding connecting terminal 14 provided on the part of the flexible printed circuit board 13 inserted into the housing 11, is also slightly pushed upward in FIG. 17 by the part of the flexible printed circuit board 13 and thereby the beam 38 is put in a condition for having a small angular motion in the clockwise direction in FIG. 17 so as to push the engaging projection 38*c* provided on the end portion 38*b* thereof downward in FIG. 17. Since the relatively small space is formed between the second engaging portion 40*b* of the cam 40 and the engaging projection 38*c* provided on the end portion 38*b* of the beam 38 of each of the conductive contacts 32, as shown in FIG. 13 and shown in enlargement in FIG. 15, the engaging projection 38*c* provided on the end portion 38*b* of the beam 38 of each of the conductive contacts 32 is able to move downward in FIG. 17 or 19 up to come into contact with the second engaging portion 40*b* of the cam 40, as shown in FIG. 17 and shown in enlargement in FIG. 19. Accordingly, the beam 38 of each of the conductive contacts 32 is operative to have the small angular motion in the clockwise direction so as to push the engaging projection 38*c* provided on the end portion 38*b* thereof downward in FIG. 17.

As a result, the beam 38 of each of the conductive contacts 32 is put in a condition in which the end portion 38*a* of the beam 38 is operative to exert an extremely small pushing force or substantially not to exert any pushing force to the part of the flexible printed circuit board 13 inserted into the housing 11 so as not to hold temporarily the flexible printed circuit board 13 substantially. That is, the beam 38 of each of the conductive contacts 32 is operative to exert an extremely small temporary holding force or substantially not to exert any temporary holding force to the part of the flexible printed circuit board 13 inserted into the housing 11.

As described above, when the actuator 25 is postured to take the first station and the flexible printed circuit board 13 is partially inserted into the housing 11, each of the conductive contacts 31 is operative to exert the temporary holding force to the part of the flexible printed circuit board 13 inserted into the housing 11 so as to hold temporary the same and each of the conductive contacts 32 is operative to exert the extremely small temporary holding force or substantially not to exert any temporary holding force to the part of the flexible printed circuit board 13 inserted into the housing 11. As a result, only each of the conductive contacts 31 is substantially operative to exert the part of the flexible printed circuit board 13 inserted into the housing 11 the temporary holding force effective practically for holding the flexible printed circuit board 13 (an effective temporary holding force).

The amount of the temporary holding force exerted by the conductive contacts 31 to the part of the flexible printed circuit board 13 inserted into the housing 11 is in proportion to the number of the conductive contacts 31. Therefore, the effective temporary holding force acting on the part of the flexible printed circuit board 13 inserted into the housing 11 can be controlled to be appropriate by selecting suitably the number of the conductive contacts 31.

Figure 20:
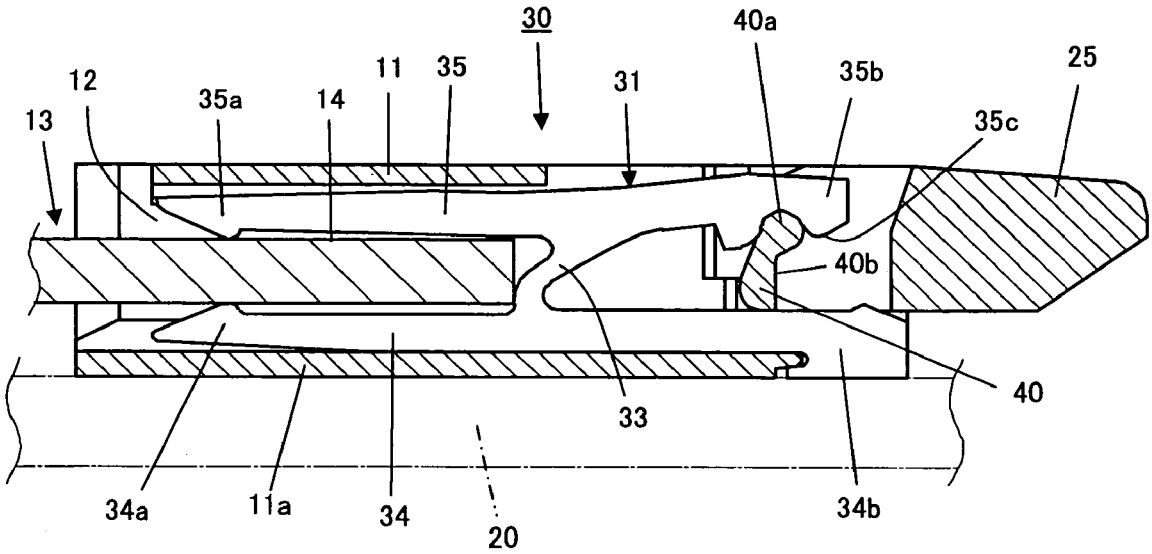
FIGS. 20 and 21 are schematic cross sectional views used for explaining the structure and operations of the second embodiment shown in FIGS. 12 and 13.
Figure 21:
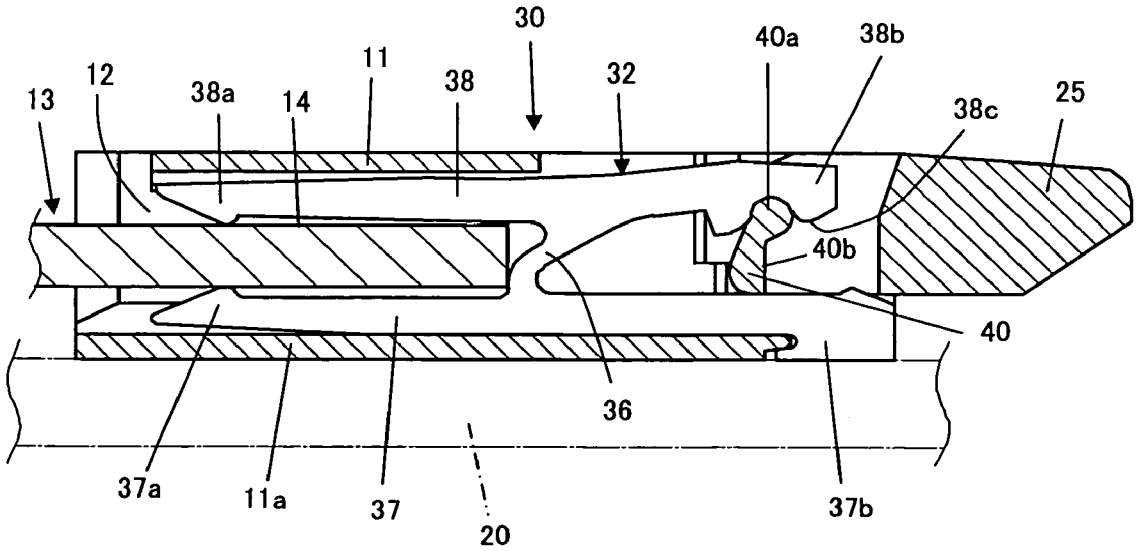

Under such a situation that the actuator 25 is postured to take the first station and the flexible printed circuit board 13 is partially inserted into the housing 11 through the opening 12 provided thereon, when the actuator 25 is rotated to shift from the first station to the second station, as shown in FIGS. 20 and 21, the beam 35 of each of the conductive contacts 31 and the beam 38 of each of the conductive contacts 32 are brought into press-contact with corresponding ones of the connecting terminals 14 provided on the part of the flexible printed circuit board 13 inserted into the housing 11, respectively, so as to hold securely the flexible printed circuit board 13.

With the rotating movement of the actuator 25 from the first station toward the second station, each of the cams 40 provided on the actuator 25 is rotated to cause the first and second engaging portions 40*a* and 40*b* thereof to vary in position.

Figure 22:
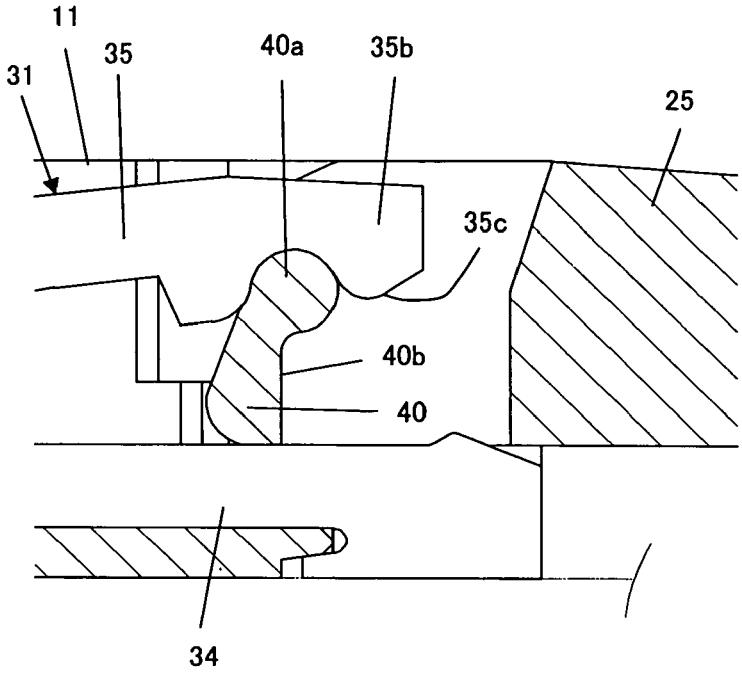
FIGS. 22 and 23 are fragmentary enlarged cross sectional views used for explaining the structure and operations of the second embodiment shown in FIGS. 12 and 13.

In such operations, as shown in FIG. 20 and shown in enlargement in FIG. 22, the first engaging portion 40*a* of each of the cams 40 corresponding to the conductive contacts 31 engages with a dent provided on the end portion 35*b* of the beam 35 of one of the conductive contacts 31 and moves slightly the end portion 35*b* of the beam 35 upward in FIG. 20 or 22. Thereby, each of the cams 40 corresponding to the conductive contacts 31 is operative to cause the end portion 35*a* of the beam 35 of one of the conductive contacts 31 to come into press-contact with the corresponding one of the connecting terminals 14 provided on the part of the flexible printed circuit board 13 inserted into the housing 11 so as to hold securely the flexible printed circuit board 13. On that occasion, the part of the flexible printed circuit board 13 on which the connecting terminals 14 are provided is put between the end portion 35*a* of the beam 35 and the end portion 34*a* of the beam 34 of each of the conductive contacts 31.

Figure 23:
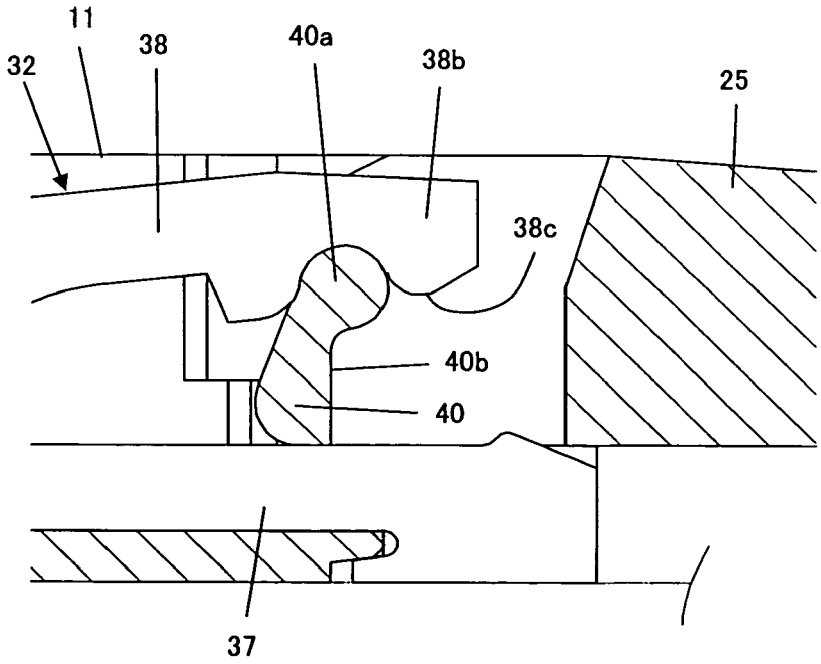

Further, as shown in FIG. 21 and shown in enlargement in FIG. 23, the first engaging portion 40*a* of each of the cams 40 corresponding to the conductive contacts 32 engages with a dent provided on the end portion 38*b* of the beam 38 of one of the conductive contacts 32 and moves slightly the end portion 38*b* of the beam 38 upward in FIG. 21 or 23. Thereby, each of the cams 40 corresponding to the conductive contacts 32 is operative to cause the end portion 38*a* of the beam 38 of one of the conductive contacts 32 to come into press-contact with the corresponding one of the connecting terminals 14 provided on the part of the flexible printed circuit board 13 inserted into the housing 11 so as to hold securely the flexible printed circuit board 13. On that occasion, the part of the flexible printed circuit board 13 on which the connecting terminals 14 are provided is put between the end portion 38*a* of the beam 38 and the end portion 37*a* of the beam 37 of each of the conductive contacts 32.

Under the situation in which the flexible printed circuit board 13 is partially inserted into the housing 11 and held by the conductive contacts 31 and 32, the actuator 25 postured to take the second station, as shown in FIGS. 20 and 21, is rotated to sift from the second station to the first station, as occasion demands. The rotating movement of the actuator 25 for shifting from the second station toward the first station is opposite in direction to that for shifting from the first station toward the second station.

The actuator 25 in the rotating movement for shifting from the second station toward the first station operates to cause each of the conductive contacts 31 and 32 to get out of press-contact with the corresponding one of the connecting terminals 14 provided on the part of the flexible printed circuit board 13 so that the flexible printed circuit board 13 is loosened from holding by the conductive contacts 31 and 32. In this operation, with the rotating movement of the actuator 25 from the second station toward the first station, the first engaging portion 40*a* of each of the cams 40 corresponding to the conductive contacts 31 disengages from the dent provided on the end portion 35*b* of the beam 35 of one of the conductive contacts 31 and the second engaging portion 40*b* of each of the cams 40 corresponding to the conductive contacts 31 comes into contact with the engaging projection 35*c* provided on the end portion 35*b* of the beam 35 of one of the conductive contacts 31. Further, the first engaging portion 40*a* of each of the cams 40 corresponding to the conductive contacts 32 disengages from the dent provided on the end portion 38*b* of the beam 38 of one of the conductive contacts 32 and the second engaging portion 40*b* of each of the cams 40 corresponding to the conductive contacts 32 takes such a position that the relatively small space is formed between the second engaging portion 40*b* of the cam 40 corresponding to the conductive contacts 32 and the engaging projection 38*c* provided on the end portion 38*b* of the beam 38 of the conductive contact 32.

Although, in the above described electrical connector 30, which constitutes the second embodiment of electrical connector according to the present invention, the conductive contacts 31 and 32 are arranged alternately in the housing 11, it is not always necessary for the electrical connector 30 according to the present invention that the conductive contacts 31 and 32 are arranged alternately in the housing 11. For example, it is possible to dispose the conductive contacts 31 at both end portions of the arrangement of the conductive contacts 31 and 32, at both end portions and a central portion of the arrangement of the conductive contacts 31 and 32, or at intervals of a predetermined number of the conductive contacts 32, so that the conductive contacts 32 are arranged between a couple of conductive contacts 31.

Further, although, in the above described electrical connector 30, which constitutes the second embodiment of electrical connector according to the present invention, two kinds of conductive contacts which are the conductive contacts 31 and 32 are provided in the housing 11 and each of the conductive contacts 31 and each of the conductive contacts 32 are different in shape with each other, it is also possible to provide in the housing 11 more than two kinds of conductive contacts different in shape. In such a case, the conductive contacts provided to be arranged in the housing 11 are operative to exert to the part of the flexible printed circuit board 13 inserted into the housing 11 a temporary holding force divided into more than two grades in intensity.

What is claimed is:

1. An electrical connector comprising;

a housing made of insulator and provided with an opening through which a circuit board is inserted into the housing, a plurality of conductive contacts arranged in the housing, each of said conductive contacts having a fixed part engaging with a board-shaped portion of the housing and an operating part movable to the fixed part, and an actuator provided to be rotatable to the housing for engaging with the conductive contacts and to take up a first station and a second station selectively for moving the operating part of each of the conductive contacts to come into press-contact with one of the connecting terminals corresponding thereto so that the circuit board is held by the conductive contacts when the circuit board is inserted into the housing through the opening provided thereon and the actuator is shifted from the first station to the second station and for moving the operating part of each of the conductive contacts to get out of press-contact with the corresponding one of the connecting terminals so that the circuit board is loosened from holding by the conductive contacts when the circuit board is inserted into the housing through the opening provided thereon and the actuator is shifted from the second station to the first station, wherein said conductive contacts arranged in the housing include first and second contacts, each of said first and second contacts are configured to have one of substantially the same space between the fixed and operating parts thereof and substantially the same space between the operating part thereof and the board-shaped portion of the housing when the actuator is postured to take the first station and the circuit board is not inserted into the housing, wherein the operating part of each of the first contacts is configured to exert a first temporary holding force on the circuit board inserted into the housing when the actuator is postured to take the first station and the circuit board is inserted into the housing through the opening provided thereon, and wherein the operating part of each of the second contacts is configured to exert a second temporary holding force on the circuit board inserted into the housing when the actuator is postured to take the first station and the circuit board is inserted into the housing through the opening provided thereon, the second temporary holding force exerted on the circuit board being different from the first temporary holding force exerted on the circuit board.

2. An electrical connector according to claim 1, wherein the actuator has a plurality of cams each engaging with one of the first and second contacts arranged in the housing and operative to move the operating part of one of the first and second contact to come into press-contact with the connecting terminal provided on the circuit board inserted into the housing through the opening provided thereon when the actuator is shifted from the first station to the second station, and each of the cams corresponding to the first contacts is configured to engage the operating part of one of the first contacts in a first predetermined position and each of the cams corresponding to the second contacts is configured to engage the operating part of one of the second contacts in a second predetermined position different from the first predetermined position when the actuator is postured to take the first station and the circuit board is inserted into the housing through the opening provided thereon.

3. An electrical connector according to claim 1, wherein the first contacts and the second contacts are arranged alternately in the housing.

4. An electrical connector according to claim 1, wherein the first contacts are disposed at intervals of a predetermined number of the second contacts.

5. An electrical connector according to claim 1, wherein the actuator is positioned at a side of the housing opposite to another side of the housing on which the opening is provided.

6. An electrical connector according to claim 1, wherein the first contacts are disposed at both end portions of an arrangement of the first and second contacts.

7. An electrical connector according to claim 6, wherein at least one of the first contacts is disposed also at a central portion of the arrangement of the first and second contacts.

8. An electrical connector comprising;

a housing made of insulator and provided with an opening through which a circuit board is inserted into the housing, a plurality of conductive contacts arranged in the housing, each of said conductive contacts having a fixed part engaging with a board-shaped portion of the housing and an operating part movable to the fixed part, and an actuator provided to be rotatable to the housing for engaging with the conductive contacts and to take up a first station and a second station selectively for moving the operating part of each of the conductive contacts to come into press-contact with one of the connecting terminals corresponding thereto so that the circuit board is held by the conductive contacts when the circuit board is inserted into the housing through the opening provided thereon and the actuator is shifted from the first station to the second station and for moving the operating part of each of the conductive contacts to get out of press-contact with the corresponding one of the connecting terminals so that the circuit board is loosened from holding by the conductive contacts when the circuit board is inserted into the housing through the opening provided thereon and the actuator is shifted from the second station to the first station, wherein said conductive contacts arranged in the housing include first and second contacts, each of said first and second contacts are configured to have one of substantially the same space between the fixed and operating parts thereof and substantially the same space between the operating part thereof and the board-shaped portion of the housing when the actuator is postured to take the first station and the circuit board is not inserted into the housing, wherein the operating part of each of the first contacts is configured to exert a first temporary holding force on the circuit board inserted into the housing when the actuator is postured to take the first station and the circuit board is inserted into the housing through the opening provided thereon, wherein the operating part of each of the second contacts is configured to exert a second temporary holding force on the circuit board inserted into the housing when the actuator is postured to take the first station and the circuit board is inserted into the housing through the opening provided thereon, the second temporary holding force exerted on the circuit board being different from the first temporary holding force exerted on the circuit board, wherein the actuator has a plurality of cams each engaging with one of the first and second contacts arranged in the housing and operative to move the operating part of one of the first and second contact to come into press-contact with the connecting terminal provided on the circuit board inserted into the housing through the opening provided thereon when the actuator is shifted from the first station to the second station, and each of the cams corresponding to the first contacts is configured to engage the operating part of one of the first contacts in a first predetermined position and each of the cams corresponding to the second contacts is configured to engage the operating part of one of the second contacts in a second predetermined position different from the first predetermined position when the actuator is postured to take the first station and the circuit board is inserted into the housing through the opening provided thereon, and wherein each of the cams corresponding to the first contacts and each of the cams corresponding to the second contacts are different in shape from each other, and each of the cams corresponding to the first contacts is operative to come into contact with the operating part of one of the first contacts and each of the cams corresponding to the second contacts is operative to be in noncontact with the operating part of any of the second contacts when the actuator is postured to take the first station and the circuit board is inserted into the housing through the opening provided thereon.

9. An electrical connector comprising;

a housing made of insulator and provided with an opening through which a circuit board is inserted into the housing, a plurality of conductive contacts arranged in the housing, each of said conductive contacts having a fixed part engaging with a board-shaped portion of the housing and an operating part movable to the fixed part, and an actuator provided to be rotatable to the housing for engaging with the conductive contacts and to take up a first station and a second station selectively for moving the operating part of each of the conductive contacts to come into press-contact with one of the connecting terminals corresponding thereto so that the circuit board is held by the conductive contacts when the circuit board is inserted into the housing through the opening provided thereon and the actuator is shifted from the first station to the second station and for moving the operating part of each of the conductive contacts to get out of press-contact with the corresponding one of the connecting terminals so that the circuit board is loosened from holding by the conductive contacts when the circuit board is inserted into the housing through the opening provided thereon and the actuator is shifted from the second station to the first station, wherein said conductive contacts arranged in the housing include first and second contacts, each of said first and second contacts are configured to have one of substantially the same space between the fixed and operating parts thereof and substantially the same space between the operating part thereof and the board-shaped portion of the housing when the actuator is postured to take the first station and the circuit board is not inserted into the housing, wherein the operating part of each of the first contacts is configured to exert a first temporary holding force on the circuit board inserted into the housing when the actuator is postured to take the first station and the circuit board is inserted into the housing through the opening provided thereon, wherein the operating part of each of the second contacts is configured to exert a second temporary holding force on the circuit board inserted into the housing when the actuator is postured to take the first station and the circuit board is inserted into the housing through the opening provided thereon, the second temporary holding force exerted on the circuit board being different from the first temporary holding force exerted on the circuit board, wherein the actuator has a plurality of cams each engaging with one of the first and second contacts arranged in the housing and operative to move the operating part of one of the first and second contact to come into press-contact with the connecting terminal provided on the circuit board inserted into the housing through the opening provided thereon when the actuator is shifted from the first station to the second station, and each of the cams corresponding to the first contacts is configured to engage the operating part of one of the first contacts in a first predetermined position and each of the cams corresponding to the second contacts is configured to engage the operating part of one of the second contacts in a second predetermined position different from the first predetermined position when the actuator is postured to take the first station and the circuit board is inserted into the housing through the opening provided thereon, and wherein the operating part of each of the first and second contacts is provided with an engaging projection, said engaging projection provided on the operating part of each of the first contacts and said engaging projection provided on the operating part of each of the second contacts being different in shape from each other, and each of the cams corresponding to the first contacts is operative to come into contact with the engaging projection provided on the operating part of one of the first contacts and each of the cams corresponding to the second contacts is operative to be in noncontact with the engaging projection provided on the operating part of any of the second contacts when the actuator is postured to take the first station and the circuit board is inserted into the housing through the opening provided thereon.

* * * * *